US005196300A

United States Patent [19]

Urabe et al.

[11] Patent Number: 5,196,300

[45] Date of Patent: Mar. 23, 1993

[54] METHOD FOR MAKING SILVER HALIDE EMULSION, PHOTOSENSITIVE MATERIALS USING THE SAME, AND METHODS OF RECORDING IMAGES USING THE PHOTOSENSITIVE MATERIALS

[75] Inventors: Shigeharu Urabe; Shunichi Aida, both of Kanagawa, Japan

[73] Assignee: Fuji Photo Film Co., Ltd., Kanagawa, Japan

[21] Appl. No.: 622,682

[22] Filed: Dec. 5, 1990

[30] Foreign Application Priority Data

Dec. 5, 1989 [JP] Japan ..... 1-316115
Jun. 19, 1990 [JP] Japan ..... 2-161054

[51] Int. Cl.[5] ..... G03C 1/015

[52] U.S. Cl. ..... 430/568; 430/569; 430/570; 430/583; 430/584; 430/585; 430/593; 430/600; 430/613; 430/627; 430/642

[58] Field of Search ..... 430/568, 569, 570, 583, 430/584, 585, 593, 600, 613, 627, 642

[56] References Cited

U.S. PATENT DOCUMENTS

| | | | |
|---|---|---|---|
| 3,661,592 | 5/1972 | Philippaerts et al. | 430/568 |
| 3,704,130 | 11/1972 | Pollet et al. | 430/568 |
| 4,725,534 | 2/1988 | Kagami et al. | 430/619 |
| 4,751,175 | 6/1988 | Aotsuka et al. | 430/569 |
| 4,830,947 | 5/1989 | Oka | 430/138 |
| 4,912,017 | 3/1990 | Takagi et al. | 430/569 |
| 4,996,140 | 2/1991 | Nakayama et al. | 430/569 |

FOREIGN PATENT DOCUMENTS

| | | |
|---|---|---|
| 0326852 | 8/1989 | European Pat. Off. . |
| 0374853 | 6/1990 | European Pat. Off. . |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A method of preparing a superfine grain emulsion with a grain size of 0.05 μm or less is provided, which includes mixing aqueous solutions of a water-soluble silver salt and a water-soluble halide with vigorous stirring inside a closed mixing device furnished with an agitator, where the solutions are fed into the device simultaneously and continuously, in the presence of at least one of a high molecular compound and a substance capable of adsorbing to silver halide, each of which has a physical retardance value of at least 40 as determined by PAGI method, and immediately expelling the newly-formed grains from the mixing device. Another method includes mixing the aqueous solutions in a mixing device as described above, immediately expelling the newly-formed grains from the device, and mixing the expelled grains with at least one of the above-described high molecular compound and substance. The silver halide photographic materials utilizing the superfine grain emulsion are suitable for holographic image-recording and image-recording with electron beam, lasers, and so on.

8 Claims, 1 Drawing Sheet

METHOD FOR MAKING SILVER HALIDE EMULSION, PHOTOSENSITIVE MATERIALS USING THE SAME, AND METHODS OF RECORDING IMAGES USING THE PHOTOSENSITIVE MATERIALS

FIELD OF THE INVENTION

This invention relates to a method of making a superfine grain emulsion suitable for silver halide photographic materials, to silver halide photographic materials obtained utilizing the method of making a superfine grain emulsion, and to methods of recording images using the photographic materials.

BACKGROUND OF THE INVENTION

Silver halide photographic emulsions have been used for more than a century, and silver halide grains have been the subject of zealous studies for many years. One of the most striking characteristics of silver halide emulsions is their excellent sharpness.

Factors determining the sharpness of a silver halide photographic material obtained by coating silver halide emulsions on a support, and then drying them, are as follows:

(1) Light scattering: Rays of light incident upon a photographic material are scattered by silver halide grains, resulting in lower sharpness.

(2) Granularity: An image obtained after development of a photographic material has a characteristic called granularity, which can be interpreted as a random-dot model and is basically attributed to fluctuations in developing individual silver halide grains.

In T. H. James, *The Theory of the Photographic Process*, 4th Ed., dependence of the scattering factor on particle size for AgBr grains and AgCl grains in emulsion films are shown in FIG. 20.6 and FIG. 20.7, respectively (on page 582). As is apparent from those figures, the light scattering factor shows a clear dependence on the grain size. More specifically, the light scattering efficiency factor decreases steeply when the grain size becomes extremely small (0.1 μ or less).

In the above-cited book, the relationship between the grain size and the granularity are shown in FIG. 21.72, which indicates that the granularity improves with a decrease in grain size. Therefore, it is understandable that the reduction of grain size is very effective for the achievement of high sharpness.

On the other hand, although silver is indispensable for silver halide emulsions, it should be used in the smallest possible amount because of its cost and finiteness as a resource. In general, the transmission density of a developed silver halide emulsion coat is expressed by the following formula (1), called the Nutting equation:

$$D=0.434\ na/A \quad (1)$$

where D is the transmission density, n is the number of grains in an area A, a is the mean projected grain area, and A is the area of the sampling aperture of the densitometer. When the total volume of silver grains present in the area A is taken as M, and the size of an emulsion grain is expressed in terms of a radius (r) of the sphere equivalent in volume, the following relations hold:

$$n = \frac{M}{4/3\pi r^3} \quad (3)$$

$$a = \pi r^2 \quad (4)$$

Substituting the above formulae (3) and (4) in the formula (1) yields the following equation (5):

$$D=0.3255\ M/(r\cdot A) \quad (5)$$

That is, when a particular amount of silver is used, the density obtained (D) is inversely proportional to the grain radius. Accordingly, silver halide grains of smaller size are required to attain a higher transmission density.

In the field of graphic arts, on the other hand, silver halide light-sensitive materials containing water-soluble rhodium salts are disclosed, e.g., in JP-A-60-83083 and JP-A-60-162246 (the term "JP-A" as used herein means an "unexamined published Japanese patent application") with the intention of obtaining a daylight photosensitive material of low sensitivity. However, the addition of rhodium salts in an amount large enough to lower the sensitivity hinders the contrast-increasing effect of hydrazine compounds, resulting in a failure to provide the desired image of sufficiently high contrast.

Because sensitivity is lowered with a decrease in grain size, the diminution in grain size is more desirable for the lowering of sensitivity than the addition of water-soluble rhodium salts. Thus, superfine grains smaller in size are desired.

As for the conventional arts, a "Lippmann" emulsion having an average grain size of 0.050 μm is disclosed as a silver bromide fine grain emulsion, e.g., in T. H. James, *The Theory of the Photographic Process*, 4th Ed. "Lippmann" emulsions have an average grain size in the range of 0.05 to 0.1 μm, and they are of great importance for photographic plates or films having high resolution, e.g., microphotographs, astrophotographs, masks for production of electronic integrated circuits, holograms, and so on.

Attempts to change operating conditions during the precipitation of silver halides have been made for the purpose of obtaining superfine grains having an average grain size of 0.05 μm or less. In one method, adding an aqueous silver salt solution and an aqueous halide solution to an aqueous protective colloid solution placed in a reaction vessel produces as many grain nuclei as possible at the time of nucleation in the initial stage of the addition. However, the continued addition of aqueous silver nitrate and halide solutions necessarily brings about the growth of the grain nuclei, so it is impossible in principle to obtain superfine grains which are extremely small in size (below 0.05 μm).

On the other hand, JP-A-01-183417 (corresponding to U.S. Pat. No. 4,879,208) discloses a method of making silver halide grains, which comprises placing a mixing device outside a reaction vessel which contains an aqueous protective colloid solution and is designed to cause the crystal growth of silver halide grains, feeding aqueous water-soluble silver salt, water-soluble halide and protective colloid solutions into the mixing device and mixing these aqueous solutions therein to form fine grains of silver halide, and immediately thereafter feeding the fine grains into the reaction vessel to perform the crystal growth of silver halide grains in the reaction vessel. In the examples of the above-cited published patent application, grains expelled from the mixing device have a size below 0.05 μm. That is to say, if nucleation is carried out in a mixing device and the grain nuclei are expelled from the mixing device as soon as they are formed, superfine grains extremely small in size can be obtained. However, the fine grains formed in the mixing device have very high solubility because of their fineness in size, so they cause so-called Ostwald ripening among themselves to result in an increase of grain size.

In other words, extremely fine grains having been once formed undergo Ostwald ripening during the washing, redispersion and redissolution steps, and an increase in grain size thereby results.

U.S. Pat. Nos. 3,661,592 and 3,704,130 disclose fine grains having grain sizes smaller than those of Lippmann emulsions (average grain size: 0.067 μm), which are formed by adding an aqueous protective colloid solution and a grain-growth inhibitor to a reaction vessel, and then adding an aqueous silver salt solution and an aqueous halide solution thereto. In such a method, the prevention of an increase in grain size is intended by protecting against grain growth subsequent to nucleation in the reaction vessel. However, it is impossible to completely prevent grain growth in the reaction vessel by allowing such adsorbents as described above to adsorb to individual grain surfaces. The average grain sizes of the fine grains demonstrated in the examples in the specifications of the above-cited two patent were within the range of 0.05 to 0.03 μm with respect to silver bromide.

Accordingly, fine grains smaller in size than Lippmann emulsions can be obtained, but it is still difficult to obtain superfine grains even smaller in size. Thus, the existing methods in the art have not made it feasible to make superfine grain emulsions having sizes far smaller than those of Lippmann emulsions, although such emulsions have been strongly desired.

Since fine grain emulsions prepared in accordance with the existing methods in the art are limited in the lower limit of their grain sizes, as described above, they are unable to ensure fully satisfactory properties for silver halide photographic materials containing them. Consequently, images recorded using those materials are insufficient in sharpness, which constitutes a very important factor in image quality, because of light-scattering and aggravation of granularity which are caused by the insufficiency in fineness of the silver halide grains.

SUMMARY OF THE INVENTION

Therefore, one object of this invention is to enable the preparation of- a superfine grain emulsion having grains which can be kept extremely small in size, and to stabilize the preparation of the superfine grain emulsion.

Another object of this invention is to provide a silver halide photographic material which contains superfine grain emulsions having grains which are extremely small in size.

Still another object of this invention is to provide methods of recording images excellent in sharpness by utilizing silver halide photographic materials which contain superfine grain emulsions having extremely small grain sizes.

The preparation of the silver halide emulsion of this invention is attained by the following Methods (A) and (B) each.

(A) A method of preparing a silver halide emulsion containing superfine grains, wherein the method comprises feeding an aqueous solution of a water-soluble silver salt and an aqueous solution of a water-soluble halide to a mixing device furnished with an agitator, mixing all the solutions in the device to form superfine silver halide grains, and expelling the formed superfine grains from the mixing device immediately thereafter, wherein the method further comprises forming the superfine grains in the presence of at least one of a high molecular weight compound and a substance capable of adsorbing to silver halide, each of which has a physical retardance value of at least 40, as determined by the PAGI (Photographic and Gelatin Industries) method, to ensure an average grain size of 0.05 μm or less.

(B) A method of preparing a superfine grain emulsion having an average grain size of 0.05 μm or less, wherein the method comprises feeding an aqueous solution of a water-soluble silver salt and an aqueous solution of a water-soluble halide to a first mixing device furnished with an agitator, mixing all the solutions in the device to form superfine silver halide grains, expelling the formed superfine grains from the mixing device immediately thereafter, and then mixing the grains in a second mixing device or a collection vessel with at least one of a solution of a high molecular weight compound and a substance capable of adsorbing to silver halide, each of which has a physical retardance value of at least 40, as determined by the PAGI method.

DETAILED DESCRIPTION OF THE INVENTION

Figure 1:
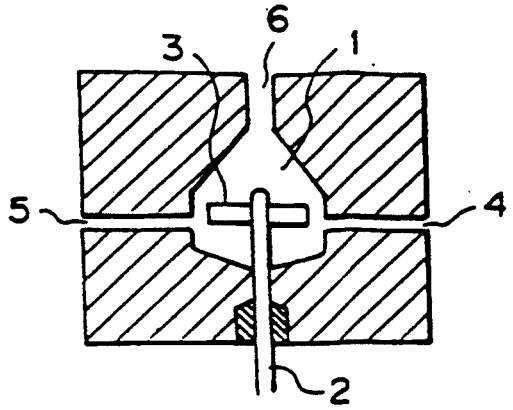
FIG. 1 is an illustration of the mixing device of this invention, including a reaction chamber 1, a rotating shaft 2, agitation blades 3, a feeding system 4 for an aqueous silver salt solution, a feeding system 5 for an aqueous halide solution, and an expulsion outlet 6.

An example of a system which provides the superfine grain formation of this invention is schematically illustrated in FIG. 1. The interior of the mixing device is provided with a reaction chamber 1. The reaction chamber 1 is equipped with agitation blades 3 mounted on a rotating shaft 2. Aqueous solutions of a silver salt, a halide and a protective colloid are introduced into the reaction chamber from their respective inlets (4, 5 and one which is not shown in the drawing).

A solution containing superfine grains produced with the aid of rapid and vigorous mixing achieved by rotating the shaft at a high speed (500 to 5,000 r.p.m.) is expelled immediately from an outlet 6. The following technical points make it feasible for the apparatus of this invention to form superfine grains.

(1) The superfine grains are expelled from the mixing device immediately after having been formed.

In conventional methods, an aqueous silver salt solution and an aqueous halide solution are added to a reaction vessel in which an aqueous protective colloid solution is present. It is important for this reaction system to generate a great number of grain nuclei at the initial stage of addition, that is, at the time of nucleation. However, continued addition of the aqueous silver salt (nitrate) solution and the aqueous halide solution necessarily brings about the growth of these grain nuclei, so it is impossible to obtain superfine grains which are extremely small in size.

In this invention, an increase in grain size is prevented by the instantaneous expulsion of the superfine grains from the mixing vessel in which they have only just been formed. Specifically, the residence time (t) of the solutions added to the mixing device is expressed by the following equation:

$$t = \frac{V}{a + b + c}$$

V: the volume of- the reaction chamber in the mixing device (ml)

a: the amount of aqueous silver nitrate solution added (ml/min)

b: the amount of aqueous halide solution added (ml/min)

c: the amount of aqueous protective colloid solution added (ml/min)

In the preparation method of this invention, t is controlled to 10 minutes or less, preferably 5 minutes or less, more preferably 1 minute or less, and most preferably 20 seconds or less. Thus, the very fine grains formed in the mixing vessel are expelled instantly from the mixing vessel without the grain size increasing.

(2) Powerful and efficient agitation is effected in the mixing device.

T. H. James, *The Theory of The Photographic Process*, p. 93, describes that "[a]nother type of grain growth that can occur [in parallel with Ostwald ripening] is coalescence. In coalescence ripening, an abrupt change in size occurs when pairs or larger aggregates of crystals are formed by direct contact and welding together of crystals that were once widely separated. Both Ostwald and coalescence ripening may occur during precipitation, as well as after precipitation has stopped." The coalescence ripening described therein tends to occur in particular in the case where grain sizes are very small and under insufficient agitation. In an extreme case, coarse massive grains are generated.

Since, as shown in FIG. 1, a closed mixing device is used in this invention, the agitation impeller in the reaction chamber can be rotated at a high speed to effect such powerful and efficient agitation as not to be realized in conventional open mixing devices (in an open system, revolution of the agitation impeller at a high speed is impractical because the centrifugal force generated thereby scatters the liquid and also causes foaming). Thus, coalescence ripening can be prevented, resulting in the formation of superfine grains which are extremely small in size. It is desirable in this invention that the number of revolutions of the agitation impeller should range from 500 r.p.m. or more, preferably 1,000 r.p.m. or more.

(3) An aqueous protective colloid solution is injected into the mixing device.

The above-described coalescence ripening can be prevented to a considerable extent by the presence of a protective colloid (peptizer) for silver halide. In this invention, the addition of an aqueous protective colloid solution to the mixing device is carried out by any of the following methods.

(a) An aqueous protective colloid solution .is injected independently into a mixing device.

A suitable concentration of the protective colloid is 1 wt % or higher, preferably 2 wt % or higher, and an appropriate flow rate thereof is at least 20%, preferably at least 50%, and more preferably at least 100%, of the total flow rate of the aqueous silver nitrate and halide solutions.

(b) A protective colloid is incorporated into an aqueous halide solution.

An appropriate concentration of the protective colloid is 1 wt % or higher, preferably 2 wt % or higher.

(c) A protective colloid is incorporated into an aqueous silver nitrate solution.

An appropriate concentration of the protective colloid is 1 wt % or higher, preferably 2 wt % or higher. When gelatin is used as the protective colloid, a silver nitrate solution and a gelatin solution should be mixed just before their use, since gelatin silver is formed between silver ions and gelatin molecules and converted to colloidal silver by undergoing photolysis and/or pyrolysis.

The above-described methods (a) to (c) may be employed independently or in any combination thereof.

A suitable reaction temperature in the mixing device is below 50° C., preferably below 40° C., and more preferably below 30° C. When reaction temperatures are below 35° C., ordinary gelatins are subject to coagulation, so it is desirable that low molecular weight gelatins (weight average molecular weight: less than 30,000) should be used.

The grain sizes obtained in accordance with the above-described techniques (1) to (3) can be confirmed by putting the grains on meshes, and observing them under a transmission electron microscope. A suitable magnification for the observation is from 20,000 to 40,000. The size of the fine grains of this invention is below 0.05 μm, preferably below 0.03 μm, and more preferably below 0.02.

The fine grains formed in the mixing device have very high solubility because of their fineness in size and, therefore, cause so-called Ostwald ripening among themselves after their expulsion from the mixing device, resulting in an increase in grain size.

That is, according to the above-described methods alone, the superfine grains experience Ostwald ripening during the subsequent processing steps, which include washing, redispersion, redissolution, chemical sensitization and storage, and an increase in grain size is caused thereby.

In this invention, the above-described problem is resolved by each of the following methods (A) and (B).

(A) In a method of forming superfine grains by feeding an aqueous solution of a water-soluble silver salt, an aqueous solution of a water-soluble halide and an aqueous protective colloid solution to a mixing device furnished with an agitator, mixing the solutions in the device to form superfine silver halide grains, and expelling the formed superfine grains from the mixing device immediately thereafter, the formation of the superfine grains is carried out in the presence of at least one of a high molecular weight compound and a substance capable of adsorbing to silver halide, each of which has a physical retardance value of at least 40, as determined by the PAGI method.

(B) A superfine grain emulsion is prepared by feeding an aqueous solution of a water-soluble silver salt, an aqueous solution of a water-soluble halide and an aqueous protective colloid solution to a mixing device furnished with an agitator, mixing the solutions in the device to form superfine silver halide grains, expelling the formed superfine grains from the mixing device immediately thereafter, and then mixing the grains with a solution of at least one of a high molecular weight compound and a substance capable of adsorbing to silver halide, each of which has a physical retardance value of at least 40, as determined by the PAGI method.

In this invention, the physical retardance is determined by the PAGI (Photographic and Gelatin Industries) method. This method is described in detail below.

1 Outline of Method

Silver chloride grains are formed in a gelatin solution and subjected to physical ripening. The resulting emulsion is examined for turbidity.

2. Instrument and Device (1) turbidimeter and spectrophotometer (2) thermostat (60.0±0.5° C.)

3. Preparation of Test Solution

| | |
|---|---|
| Solution A: | |
| Sodium chloride | 17.6 g |
| M/2 Sulfuric acid | 100 ml |
| Water to make | 1,000 ml |
| Solution B: | |
| Silver nitrate | 17.0 g |
| Water to make | 1,000 ml |

The reagents used are all special grade or equivalent thereto.

(1) 30 g of a sample gelatin is dissolved in 300 ml of water. A 100 ml portion of the resulting solution is admixed with a 20 ml portion of the solution A and heated at 60.0±0.5° C.

(2) A 20 ml portion of the solution B (at 60° C.) is added over a 2- to 3-second period to the above-described mixture with stirring.

(3) The thus prepared silver chloride emulsion is physically ripened at 60.0±0.5° C. for 20 minutes. During the ripening, the emulsion is stirred by moving a glass rod around 20 times in the period after a 10-minute lapse after the beginning of ripening and just before the conclusion of the ripening.

(4) A 5 ml portion of the thus ripened emulsion is pipetted and admixed with 30 ml of water (room temperature) with stirring to prepare a test solution.

4. Measurement (1) Transmittance at 600 nm is measured with a spectrophotometer.

(2) A cell 10 mm in thickness is used.

According to this invention, the superfine grains are either formed in the presence of or mixed with at least one of a high molecular weight compound (a protective colloid polymer) and a substance capable of absorbing to silver halide (a grain-growth retarder), each of which has a physical retardance value of at least 40, as determined by the PAGI method set forth above. The protective colloid polymers and grain-growth retarders are described in detail below.

Protective Colloid Polymers

Protective colloid polymers which can be used are roughly divided into main three groups: gelatins, other natural polymers, and synthetic polymers. The physical retardance of gelatins is determined by the PAGI method described above. Natural polymers, other than gelatins, and synthetic polymers can be also examined for physical retardance in accordance with the same PAGI method, except that the polymers are substituted for the gelatins in the same amount. A requirement for the protective colloid polymers to be used in this invention is that their physical retardance be at least 40. Specific examples of polymers which satisfy said the requirement are given below.

(1) Gelatin retarders having high physical retardance (gelatins having high adenine and guanidine contents).

(2) Polyvinyl pyrrolidones; Vinyl pyrrolidone homopolymer and acrolein-vinyl pyrrolidone copolymers disclosed in French Patent 2,031,396.

(3) Polyvinyl alcohols; Vinyl alcohol homopolymer, organic acid monoesters of polyvinyl alcohols disclosed in U.S. Pat. No. 3,000,741, maleic acid esters of polyvinyl alcohols disclosed in U.S. Pat. No. 3,236,653, and vinyl alcohol-vinyl pyrrolidone copolymers disclosed in U.S. Pat. No. 3,479,189.

(4) Polymers having thioether groups; Thioether group-containing polymers disclosed in U.S. Pat. Nos. 3,615,624, 3,860,428 and 3,706,564.

(5) Polyvinylimidazoles;

Vinyl imidazole homopolymer, vinyl imidazole-vinyl amide copolymers, and acrylamide-acrylic acid-vinyl imidazole terpolymers disclosed in JP-B-43-7561 (the term "JP-B" as used herein means an "examined Japanese patent publication"), and German Patents 2,012,095 and 2,012,970.

(6) Polyethyleneimines.

(7) Acetal polymers; Water-soluble polyvinyl acetals disclosed in U.S. Pat. No. 2,358,836, carboxyl group-containing polyvinyl acetals disclosed in U.S. Pat. No. 3,003,879, and polymers disclosed in British Patent 771,155.

(8) Amino polymers; Amino polymers disclosed in U.S. Pat. Nos. 3,345,346, 3,706,504 and 4,350,759, and West German Patent 2,138,872, quaternary amine-containing polymers disclosed in British Patent 1,413,125 and U.S. Pat. No. 3,425,836, polymers containing both amino and carboxyl groups disclosed in U.S. Pat. No. 3,511,818, and polymers disclosed in U.S. Pat. No. 3,832,185.

(9) Acrylamide polymers; Acrylamide homopolymer, acrylamide-imidated acrylamide copolymers disclosed in U.S. Pat. No. 2,541,474, acrylamide-methacrylamide copolymers disclosed in West German Patent 1,202,132, partially aminated acrylamide polymers disclosed in U.S. Pat. No. 3,284,207, and substituted acrylamide polymers disclosed in JP-B-45-14031, U.S. Pat. Nos. 3,713,834 and 3,746,548, and British Patent 788,343.

(10) Hydroxyquinoline-containing polymers; Hydroxyquinoline-containing polymers disclosed in U.S. Pat. Nos. 4,030,929 and 4,152,161.

(11) Others; Azaindenyl group-containing polymers disclosed in JP-A-59-8604, polyalkylene oxide derivatives disclosed in U.S. Pat. No. 2,976,150, polyvinylamine imides disclosed in U.S. Pat. No. 4,022,623, polymers disclosed in U.S. Pat. Nos. 4,294,920 and 4,089,688, polyvinylpyridines disclosed in U.S. Pat. No. 2,484,456, imidazolyl group-containing vinyl polymers disclosed in U.S. Pat. No. 3,520,857, triazolyl group-containing vinyl polymers disclosed in JP-B-60-658, and water-soluble polyalkyleneaminotriazoles described in *Zeischrift Wissenschaftrilich Photographie*, Vol. 45, p. 43 (1950).

Secondly, substances capable of retarding the growth of superfine grains through the adsorption to silver halides (which are called "grain-growth retarders", hereinafter) are described below.

2. Grain-Growth Retarders

In the determination of the physical retardance according to the PAGI method, 30 g of an inert gelatin having a physical retardance ranging from 10 to 15 is used as a protective colloid, and $2\times10^{-5}$ mole of an adsorbent is added to the gelatin solution. Then, the resulting gelatin solution is examined for physical retardance. Adsorbents which realize a physical retardance of at least 40 under the above-described condition are those which satisfy the objects of this invention.

The adsorbents applicable to this invention are illustrated more specifically below.

1-1 Nitrogen-containing heterocyclic compounds which have one or more mercapto groups to form mercaptosilver in combination with a silver ion:

Specific examples thereof are illustrated below.

(I-1)

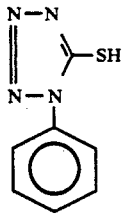

(I-2)

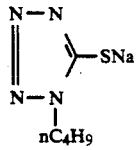

(I-3)

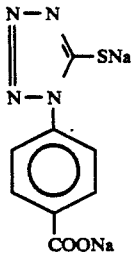

(I-4)

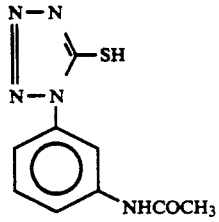

-continued (I-5)

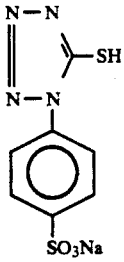

(I-6)

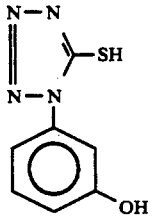

(I-7)

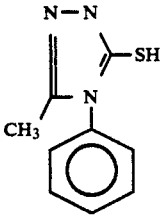

(I-8)

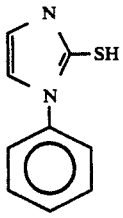

(I-9)

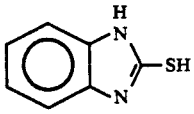

(I-10)

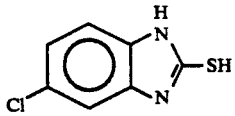

(I-11)

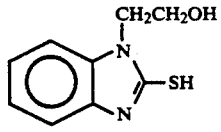

(I-12)

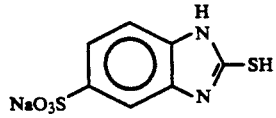

(I-13)

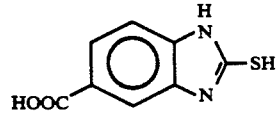

-continued
(I-14)
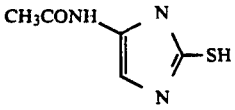
(I-15)
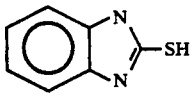
(I-16)
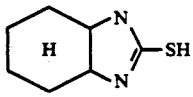
(I-17)
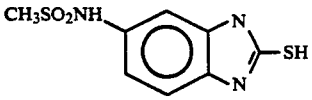
(I-18)
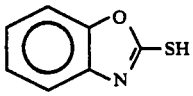
(I-19)
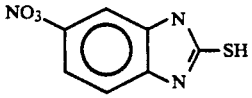
(-20)
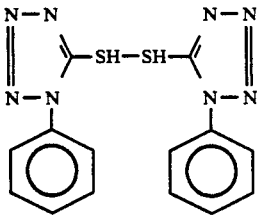
(I-21)
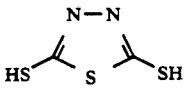
(I-22)
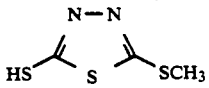
(I-23)
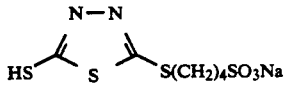
(I-24)
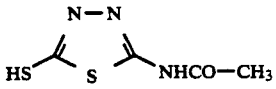
(I-25)
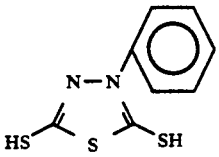
(I-26)
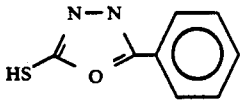
-continued
(I-27)
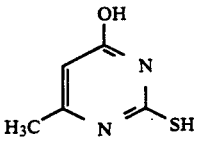
(I-28)
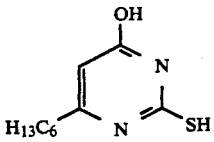
(I-29)
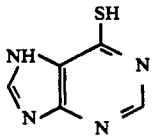
(I-30)
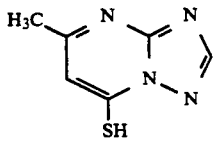
(I-31)
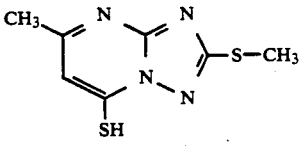
(I-32)
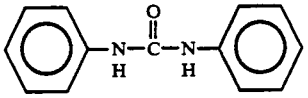
(I-33)
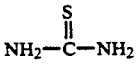
(I-34)
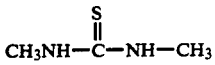
(I-35)
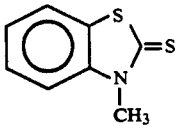
(I-36)
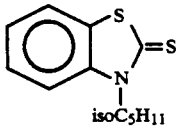
(I-37)
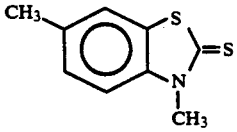
(I-38)
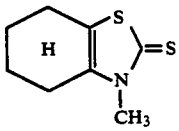

-continued
(I-39)
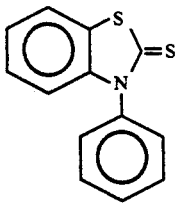
(I-40)
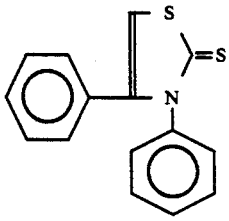
(I-41)
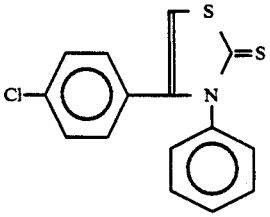
(I-42)
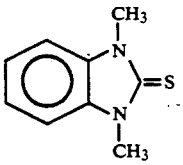
(I-43)
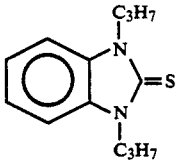
(I-44)
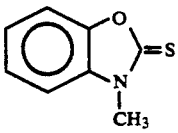
(I-45)
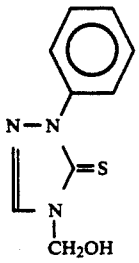
-continued
(I-46)
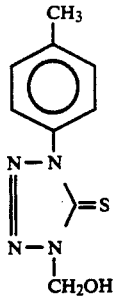
I-47
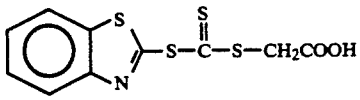
2-2 Nitrogen-containing heterocyclic compounds which can form iminosilver in combination with silver ion:
Specific examples thereof are illustrated below.
(II-1)
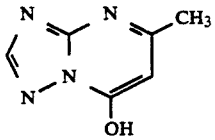
(II-2)
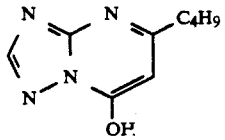
(II-3)
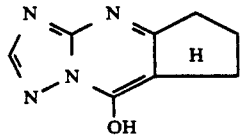
(II-4)
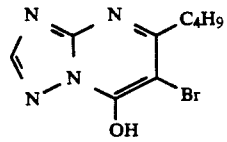
(II-5)
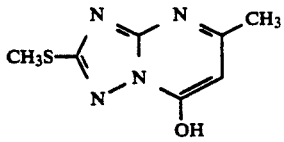
(II-6)
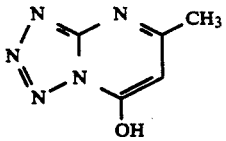
(II-7)
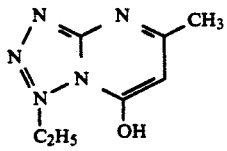

-continued (II-8)

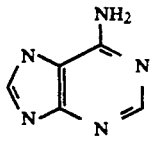

(II-9)

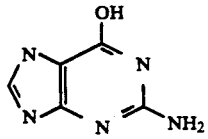

(II-10)

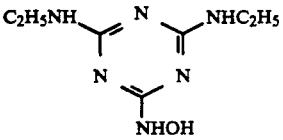

(II-11)

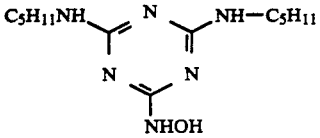

(II-12)

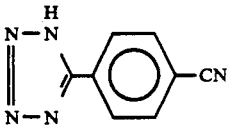

(II-13)

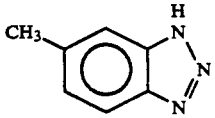

(II-14)

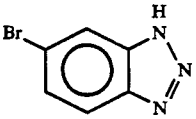

(II-15)

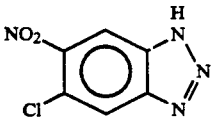

(II-16)

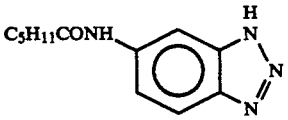

(II-17)

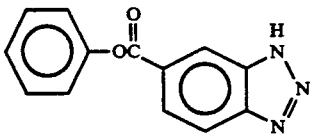

(II-18)

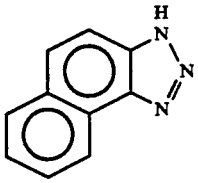

-continued (II-19)

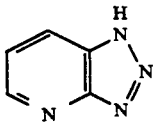

(II-20)

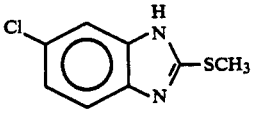

(II-21)

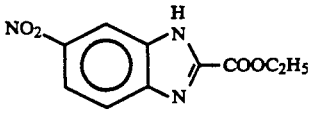

(II-22)

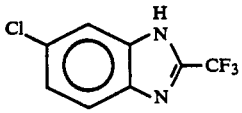

(II-23)

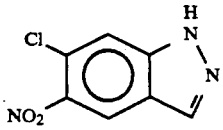

(II-24)

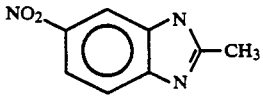

2-3 Quaternary nitrogen-containing heterocyclic compounds:

Specific examples thereof are illus.rated below.

(III-1)

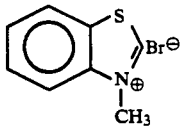

(III-2)

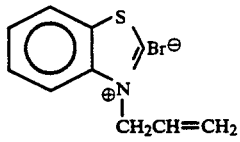

(III-3)

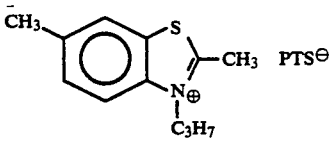

(III-4)

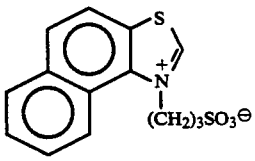

2-4 Sensitizing dyes:

In this invention, sensitizing dyes can be used because they have a grain-growth retarding effect. Moreover, it becomes necessary to spectrally sensitize the superfine grain emulsions of this invention, if needed by the end-use purpose, e.g., in order to impart thereto spectral sensitivities suitable for spectral characteristics of light to be used for recording images. In such a case, it is quite reasonable to use sensitizing dyes having both grain-growth retardation and spectral sensitization functions.

The amount of the sensitizing dye used in the invention changes by the size of the superfine grain silver halide emulsion, the adsorption of the sensitizing dye, and the solubility of the sensitizing dye to a solvent. Thus it is difficult to define the amount of the sensitizing dye. In general, however, the amount of the sensitizing dye is about $1\times10^{-5}$ mol to 1 mol, preferably about $3\times10^{-3}$ to $5\times10^{-1}$ mol per mol of silver halide. Depending on the type of the protective colloid and the grain growth retarder, the protective colloid and the grain growth retarder, the sensitizing dye may be used in a smaller amount than defined above.

Sensitizing dyes which can be used in this invention include cyanine dyes, merocyanine dyes, or complex cyanine dyes. Preferred dyes are represented by the following formula (I) or (II):

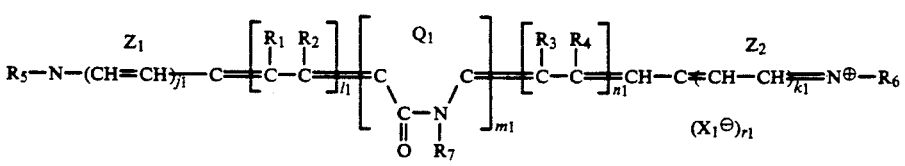

(I)

In the foregoing formula, $Z_1$ and $Z_2$ may be the same or different, and each represents nonmetal atoms completing a 5- or 6-membered nitrogen-containing hetero ring, with specific examples- including thiazoline, thiazole, benzothiazole, naphthothiazole, selenazoline, selenazole, benzoselenazole, naphthoselenazole, oxazole, benzoxazole, naphthoxazole, benzimidazole, naphthimidazole, pyridine, quinoline, indolenine, imidazo[4,5-b]quinoxaline and benzotellurazole rings. These hetero rings may have one or more substituent groups. Suitable examples of such substituent groups include lower alkyl groups (preferably containing 1 to 6 carbon atoms, which may be further substituted by a hydroxyl group, a halogen atom, phenyl group, a substituted phenyl group, a carboxyl group, an alkoxy carbonyl group, an alkoxy group, or some other substituent), lower alkoxy groups (preferably containing 1 to 6 carbon atoms), acylamino groups (preferably containing less than 8 carbon atoms), a $C_{6-12}$ monocyclic aryl group, carboxyl group, lower alkoxycarbonyl groups (preferably containing less than 6 carbon atoms), a hydroxyl group, cyano group, halogen atoms, and so on.

In addition, when the hetero ring represented by $Z_1$ or $Z_2$ contains the other nitrogen atom which can have a substituent group, e.g., benzimidazole, naphthoimidazole, imidazo-[4,5-b]quinoxaline or the like, that nitrogen atom may have a substituent group such as an alkyl or alkenyl group containing 1 to 6 carbon atoms (which may be further substituted by a hydroxyl group, an alkoxy group, a halogen atom, a phenyl group, an alkoxycarbonyl group or some other substituent).

$Q_1$ represents atoms to complete a 5- or 6-membered nitrogen-containing ketomethine ring, such as thiazolidine-4-one, selenazolidine-4-one, oxazolidine-4-one, imidazolidine-4-one, or the like.

$R_1$, $R_2$, $R_3$ and $R_4$ each represents a hydrogen atom, a lower alkyl group (preferably containing 1 to 4 carbon atoms), or an optionally substituted phenyl or $C_{6-12}$ aralkyl group. In addition, when $l_1$ represents 2 or 3, or when $n_1$ represents 2 or 3, a 5- or 6-membered ring which may contain oxygen, sulfur, nitrogen and/or other hetero atoms can be formed by combining $R_1$ with another $R_1$, $R_2$ with another $R_2$, $R_3$ with another $R_3$, or $R_4$ with another $R_4$.

$R_5$, $R_6$ and $R_7$ each represents an optionally substituted alkyl or alkenyl group which contains 1 to 10 carbon atoms, and may contain one or more oxygen, sulfur or nitrogen atoms in its carbon chain. Suitable examples of substituent groups which they may have include a sulfo group, a carboxyl group, a hydroxyl group, a halogen atom, an alkoxycarbonyl group, a carbamoyl group, a phenyl group, a substituted phenyl group, and so on.

In formula (I), $l_1$ and $n_1$ each represents 0 or a positive integer of 3 or less, provided that $l_1+n_1$ is 3 or less. When $l_1$ is 1, 2 or 3, $R_5$ may combine with $R_1$ to form a 5- or 6-membered ring.

In addition, $j_1$, $k_1$ and $m_1$ each represents 0 or 1.

$X_1^-$ represents an acid anion, and $r_1$ represents 0 or 1.

It is to be desired in the formula (I) that at least one among the substituents $R_5$, $R_6$ and $R_7$ should be a group containing a sulfo or carboxyl group.

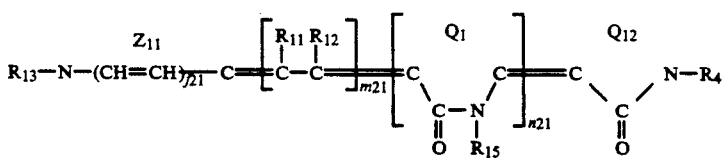

(II)

In the above formula (II), $Z_{11}$ represents atoms to complete a 5- or 6-membered nitrogen-containing hetero ring. For instance, it completes a heterocyclic nucleus to be used for forming one of conventional cyanine dyes, with specific examples including thiazoline, thiazole, benzothiazole, naphthothiazole, selenazoline, selenazole, benzoselenazole, naphthoselenazole, oxazole, benzoxazolene, naphthoxazole, benzimidazole, naphthimidazole, pyridine, quinoline, pyrrolidine, indolenine, imidazo[4,5-b]quinoxaline, tetrazole and like nuclei. These heterocyclic nuclei each may be substituted, e.g., by a lower alkyl group (preferably containing 1 to 10 carbon atoms, which may be further substituted by a hydroxyl group, a halogen atom, phenyl group, a substituted phenyl group, carboxyl group, an alkoxycarbonyl group, an alkoxy group, or some other substituent), a lower alkoxy group (preferably containing 1 to 7 carbon atoms), an acylamino group (preferably containing 1 to 8 carbon atoms), a $C_{6-12}$ monocyclic aryl group, a $C_{6-12}$ monocyclic aryloxy group, a carboxyl group, a lower alkoxycarbonyl group (preferably containing 2 to 7 carbon atoms), a hydroxy group, a cyano group, a halogen atom, or some other substituent).

$Q_{11}$ represents atoms to complete a 5- or 6-membered nitrogen-containing ketomethine ring, such as thiazolidine-4-one, selenazolidine-4-one, oxazolidine-4-one, imidazolidine-4-one, or the like.

$Q_{12}$ represents atoms to complete a 5- or 6-membered ketomethylene ring. Examples Of such atoms include those completing heterocyclic nuclei to constitute conventional merocyanine dyes, such as rhodanine, 2-thiohydantoin, 2-selenathiohydantoin, 2-thioxazolidine-2,4-dione, 2-selenaoxazolidine-2,4-dione, 2-thioselenazolidine-2,4-dione, 2-selenathiazoline-2,4-dione, 2-selenazolidine-2,4-dione, and the like.

When the atoms completing the heterocyclic ring represented by $Z_{11}$, $Q_{11}$ or $Q_{12}$ contain not less than two nitrogen atoms as their constituents, as in the case Of benzimidazole, thiohydantoin or a like ring, one or more nitrogen atoms other than the one which combines with $R_{13}$, $R_{14}$ or $R_{15}$, respectively, may be substituted, e.g., by an alkyl or alkenyl group containing 1 to 8 carbon atoms, in which a carbon atom in its alkyl chain may be replaced by an oxygen, sulfur or nitrogen atom, or may have a substituent group, or an optionally substituted monocyclic aryl group.

$R_{11}$ represents a hydrogen atom or an alkyl group containing 1 to 4 carbon atoms, and $R_{12}$ represents a hydrogen atom, or a phenyl group (which may be substituted, e.g., by an alkyl or alkoxy group containing 1 to 4 carbon atoms, a halogen atom, a carboxyl group, a hydroxyl group, or some other substituent), or a $C_{1-8}$ alkyl group (which may be substituted, e.g., by a hydroxyl group, a carboxyl group, an alkoxy group, a halogen atom, or some other substituent). When $m_{21}$ represents 2 or 3, $R_{12}$ may combine with another $R_{12}$ to complete a 5- or 6-membered ring in which an oxygen, sulfur or nitrogen atom may be contained.

$R_{13}$ represents an optionally substituted alkyl or alkenyl group which contains 1 to 10 carbon atoms, and may contain one or more oxygen, sulfur or nitrogen atoms in its carbon chain. Suitable examples of substituent groups which they may have include a sulfo group, a carboxyl group, a hydroxyl group, a halogen atom, an alkoxycarbonyl group, a carbamoyl group, a phenyl group, a substituted phenyl group, and a monocyclic saturated heterocyclic group.

$R_{14}$ and $R_{15}$ have the same meaning as $R_{13}$, and additionally may represent a hydrogen atom or a $C_{6-12}$ monocyclic aryl group (which may be substituted, e.g., by a sulfo group, a carboxyl group, a halogen atom, an alkyl, acylamino or alkoxy group containing 1 to 5 carbon atoms, or some other substituent).

In formula (II), $m_{21}$ represents 0 or a positive integer of 3 or less, $j_{21}$ represents 0 or 1, and $n_{21}$ represents 0 or 1. When $m_{21}$ is 1, 2 or 3, $R_{11}$ may combine with $R_{13}$ to form a 5- or 6-membered ring.

It is to be desired in the formula (II) that at least one among the substituents $R_{13}$, $R_{14}$ and $R_{15}$ should be a group containing a sulfo or carboxyl group.

Specific examples of compounds represented by the formula (I) are illustrated below.

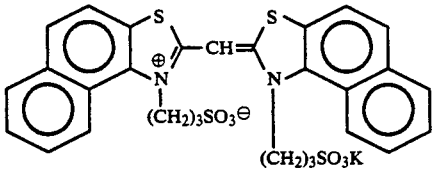

(IV-1)

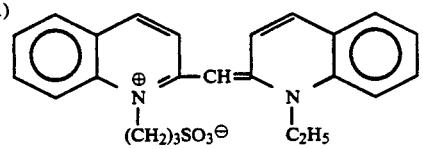

(IV-2)

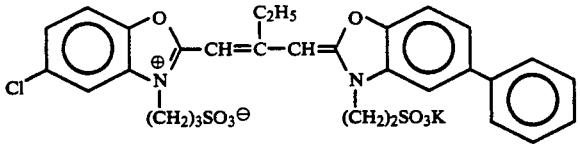

(IV-3)

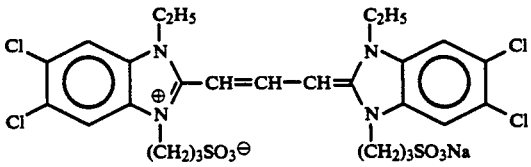

(IV-4)

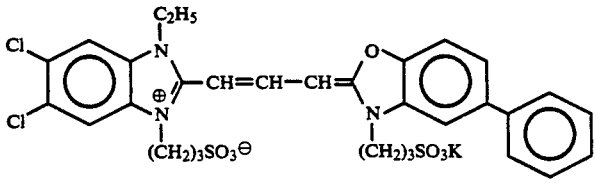

(IV-5)

-continued
(IV-6)
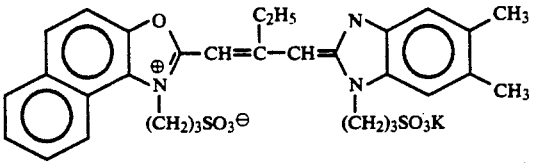
(IV-7)
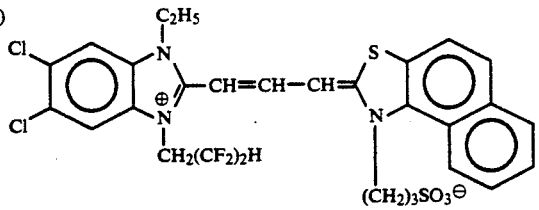
(IV-8)
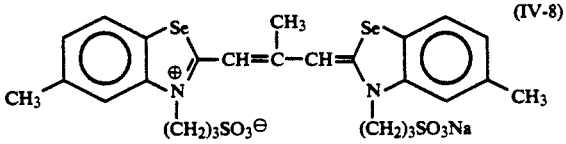
(IV-9)
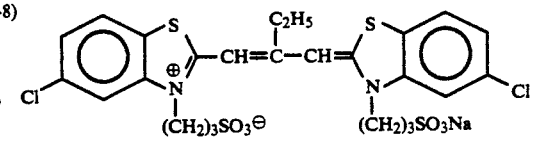
(IV-10)
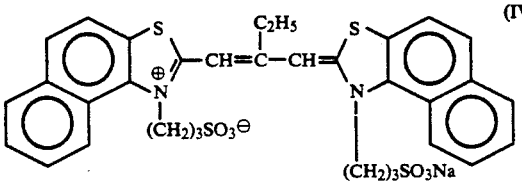
(IV-11)
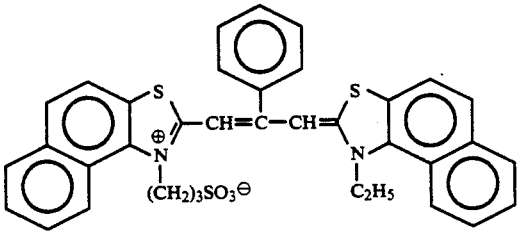
(IV-12)
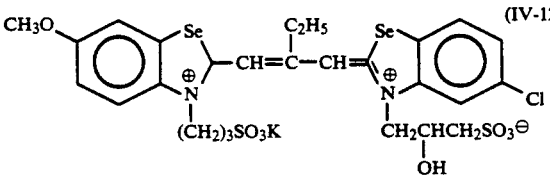
(IV-13)
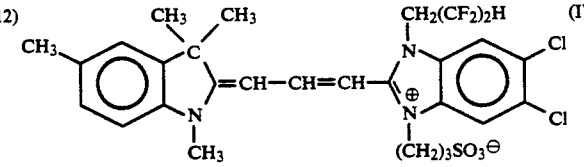
(IV-14)
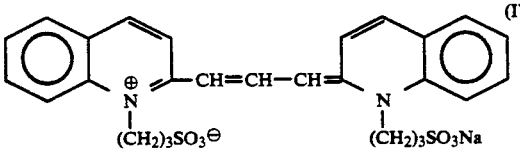
(IV-15)
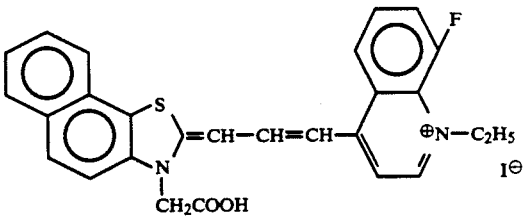
(IV-16)
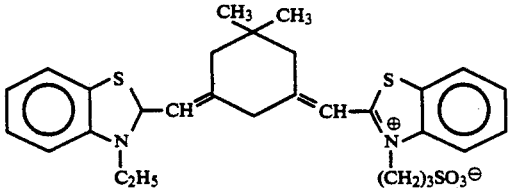
(IV-17)
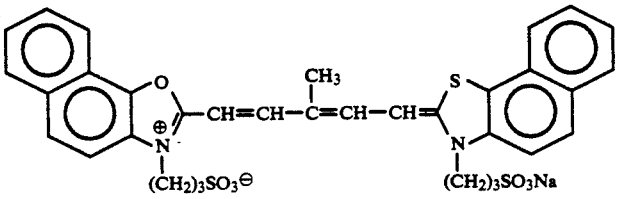

-continued
(IV-18)
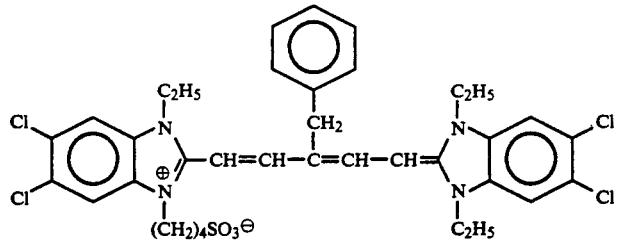
(IV-19)
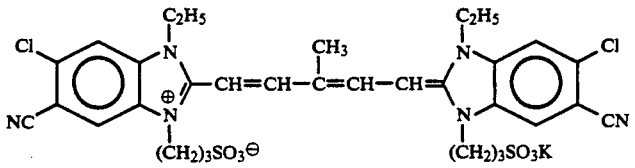
(IV-20)
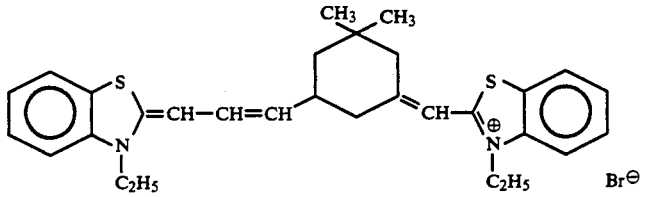
(IV-21)
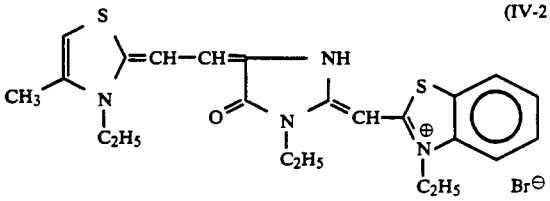
(IV-22)
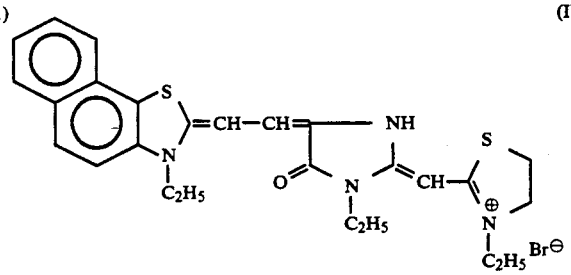
(IV-23)
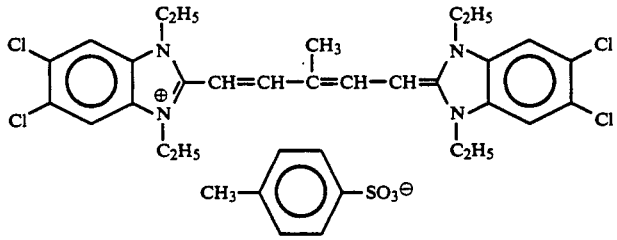
(IV-24)
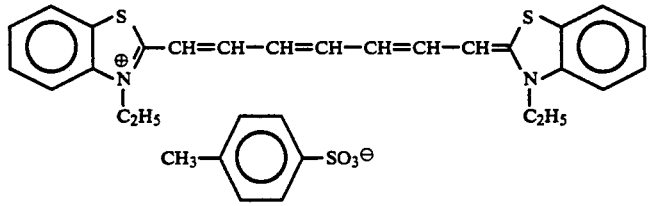
(IV-25)
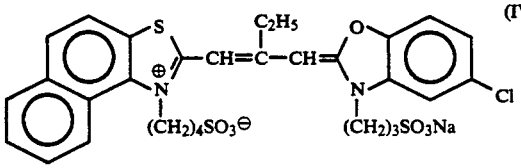
(IV-26)
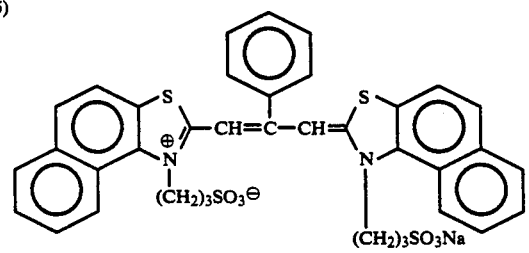

-continued
(IV-27)
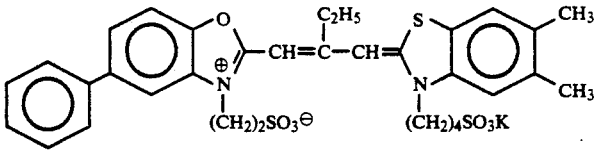
(IV-28)
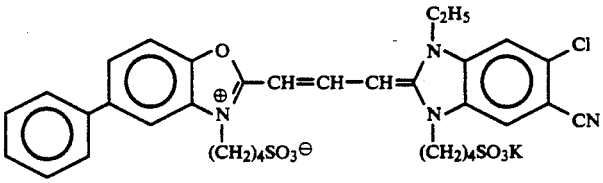
(IV-29)
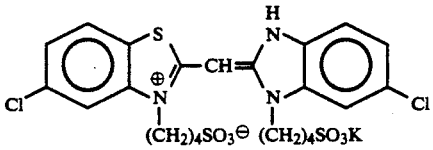
(IV-30)
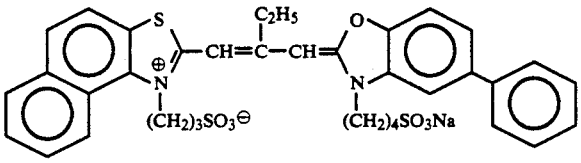
(IV-31)
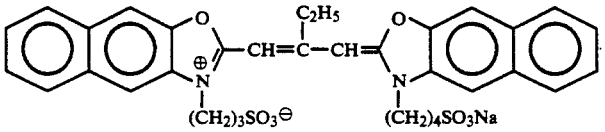
(IV-32)
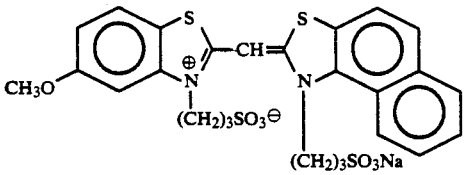
(IV-33)
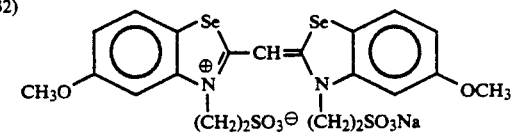
Specific examples of compounds represented by the formula (II) are illustrated below.
(V-1)
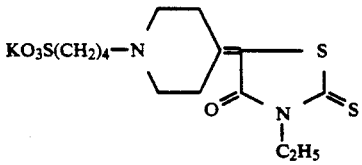
(V-2)
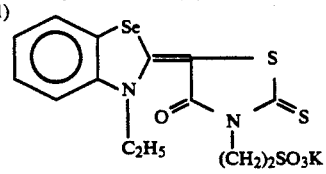
(V-3)
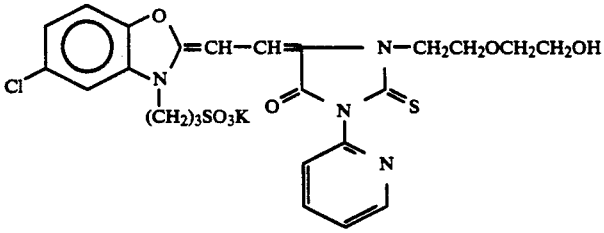
(V-4)
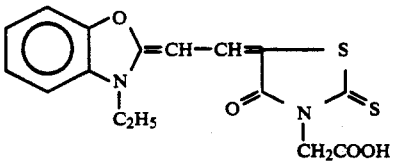
(V-5)
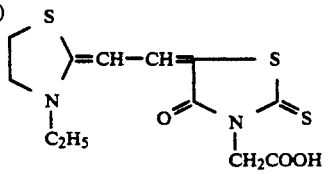

-continued (V-6)

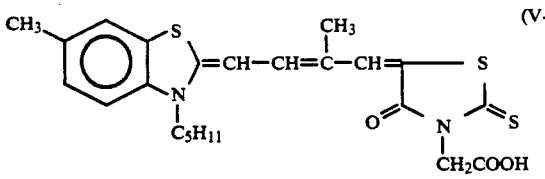

(V-7)

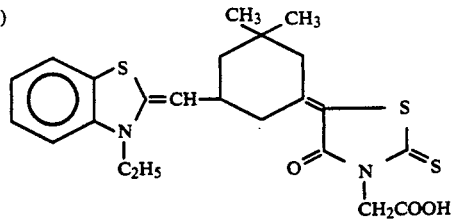

(V-8)

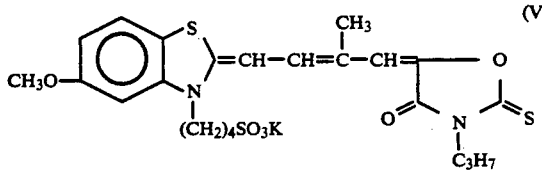

(V-9)

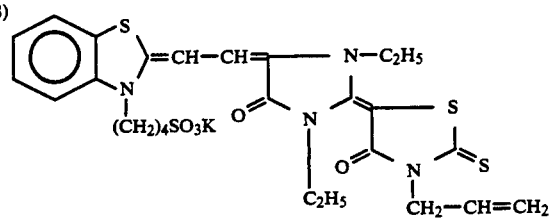

(V-10)

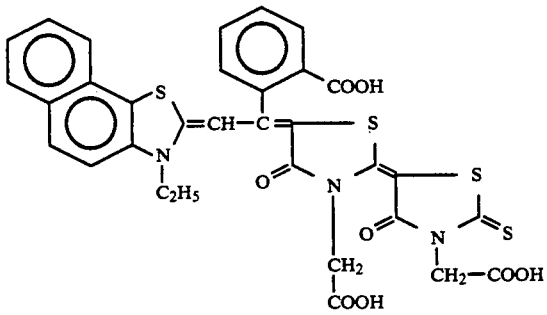

(V-11)

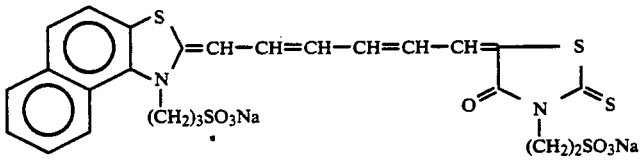

(V-12)

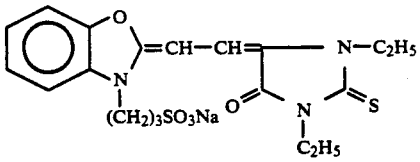

The superfine grain emulsion prepared in accordance with this invention- may have any halide composition, including iodide, iodobromide, bromide, chlorobromide, chloride, chloroiodide and chloroiodobromide.

As for the particular apparatus to be used in forming superfine grains- in accordance with this invention, those disclosed in the patents specified below can be employed.

JP-A-164719, JP-A-2-163735, JP-A-2-172815 and JP-A-2-167819 are cited with respect to the formation of superfine grains, JP-A-2-167817 with respect to the structure of a mixing device, and JP-A-2-172816 with respect to the desalting and the concentration of a superfine grain emulsion by means of a functional film.

Specific methods to be employed in adding the high molecular compounds (protective colloid polymers) and the grain-growth retarders of this invention, each of which has a physical retardance value of at least 40, as determined by the PAGI method, are described below.

Method A

The protective colloid polymer of this invention can be used in three ways. That is, one way involves the independent injection of an aqueous protective colloid polymer solution into a mixing device, a second way involves the addition of the protective colloid polymer to an aqueous halide solution, and a third way involves the addition of the protective colloid polymer to an aqueous silver salt solution. These three ways may be used independently or combined in any manner. Of course, the three may be carried out at the same time. Also, the protective colloid polymers of this invention can be used in combination with gelatins.

The grain-growth retarders of this invention are used in combination with the protective colloid polymer or gelatins (including low molecular weight ones) since they themselves do not function as protective colloids. Specifically, the grain-growth retarders can be used two ways. One way involves the addition of the grain-growth retarder to an aqueous solution of a protective colloid polymer or gelatin, and the other way involves the addition of the grain-growth retarder to an aqueous halide solution. These two ways may be carried out at the same time.

Method B

Figure 2:
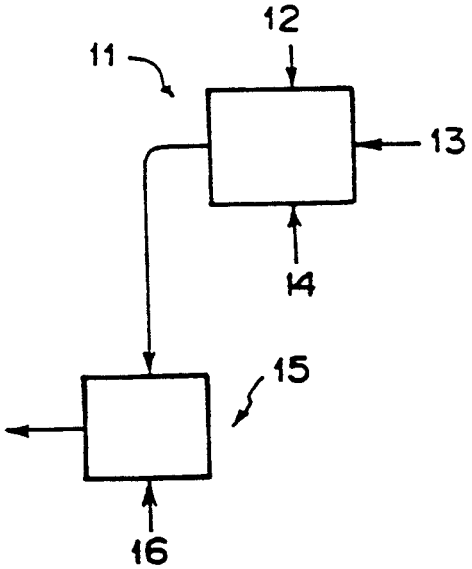
FIG. 2 and FIG. 3 illustrate schematically the methods of this invention, including mixing devices 11 and 21 for the formation of superfine grains, aqueous silver nitrate solutions 12 and 22, aqueous protective colloid solutions 13 and 23, aqueous halide solutions 14 and 24, a second mixing device 15, an aqueous protective colloid solution (grain growth retarder) 16, a collection vessel 25, and an agitator 26.

In Method B, superfine grains are expelled from the mixing vessel as soon as they are formed, and the expelled emulsion is introduced immediately into a second mixing device. Simultaneously with the introduction of this emulsion, an aqueous solution of the protective colloid polymer or the grain-growth retarder of this invention is injected into the second mixing device, and mixed therein. This system is schematically shown in FIG. 2. A mixing device such as that shown in FIG. 1 is used as the second mixing device. The time taken to introduce the emulsion expelled from the mixing device used for grain formation into the second mixing device is controlled to 10 minutes or less, preferably 5 minutes or less, more preferably 1 minute or less, and most preferably 30 seconds or less. The residence time of the emulsion in the second mixing device is controlled to 5 minutes or less, preferably 1 minute or less, and more preferably 30 seconds or less.

Figure 3:
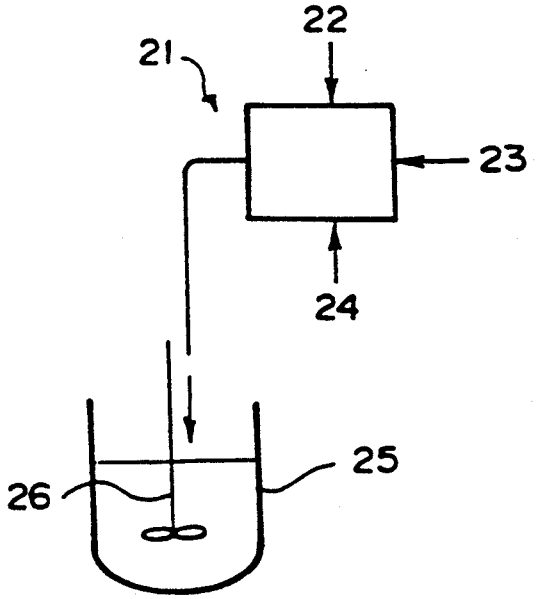

Instead of using the second mixing device, a collection vessel having an agitator, such as that shown in FIG. 3, can be used, and the superfine grain emulsion expelled from the mixing device and the protective colloid polymer and/or the grain-growth retarder of this invention are mixed therein.

The time taken to introduce the emulsion expelled from the mixing device used for the formation of superfine grains into the collection vessel is controlled to 10 minutes or less, preferably 5 minutes or less, more preferably 1 minute or less, and most preferably 30 seconds or less.

In both Methods A and B of this invention, the protective colloid polymer and the grain-growth retarder are used in the following amounts, respectively.

Protective colloid polymer 5 g/mol Ag or more, preferably 10 g/mol Ag or more, and more preferably 20 g/mol Ag or more.

Grain-growth retarder $10^{-5}$ mol/mol Ag or more, preferably $10^{-4}$ mol/mol Ag or more, and more preferably $10^{-3}$ mol/mol Ag or more.

Emulsions relating to this invention can be spectrally sensitized.

In general, methine dyes are used as spectral sensitizing dyes in this invention. They include cyanine dyes, merocyanine dyes, complex cyanine dyes, complex merocyanine dyes, holopolar cyanine dyes, hemicyanine dyes, styryl dyes, and hemioxonol dyes. Any nuclei usually present in cyanine dyes can be the basic heterocyclic nuclei of the above-cited dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-cited nuclei and an alicyclic hydrocarbon ring; and nuclei formed by fusing together one of the above-cited nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline and like nuclei. Each of these nuclei may have a substituent group on a carbon atom.

The merocyanine and complex merocyanine dyes can contain 5- or 6-membered heterocyclic nuclei, such as pyrazoline-5-one, thiohydantoin, 2-thioxazolidine-2,4-dione, thiazolidine-2,4-dione, rhodanine, thiobarbituric acid and like nuclei, as ketomethylene structure-containing nuclei.

Sensitizing dyes are added to emulsions before, during, or after chemical ripening. It is most desirable that sensitizing dyes should be added to the silver halide grains of this invention before or during the chemical ripening (e.g., at the time of grain formation or physical ripening).

The superfine grain silver halide emulsion of this invention is usually subjected to desalting (including flocculation step, redispersion step, etc).

The superfine grain silver halide emulsion of this invention is usually chemically sensitized.

More specifically, sulfur sensitization using active gelatin or compounds containing sulfur capable of reacting with silver ions (e.g., thiosulfates, thioureas, mercapto compounds, and rhodanines), reduction sensitization using reducing materials (e.g., stannous salts, amines, hydrazine derivatives, formamidine sulfinic acid, and silane compounds), sensitization with noble metal compounds (e.g., gold complexes, and complexes of Group VIII metals, such as Pt, Ir, Pd, etc.), and so on can be employed individually or as a combination thereof.

The photographic emulsions to be used in this invention can contain a wide variety of compounds for the purposes of preventing fog or stabilizing photographic functions during production, storage, or photographic processing. Specifically, azoles such as benzothiazolium salts, nitroindazoles, triazoles, benzotriazoles, and benzimidazoles (especially nitro- or halogen-substituted ones); heterocyclic mercapto compounds, such as mercaptothiazoles, mercaptobenzothiazoles, mercaptobenzimidazoles, mercaptothiadiazoles, mercaptotetrazoles (especially 1-phenyl-5-mercaptotetrazole) and mercaptopyrimidines; the same heterocyclic mercapto compounds as cited above, except for containing one or more water-soluble groups, such as a carboxyl group, sulfo group, etc.; thioketo compounds, such as oxazolinethione; azaindenes, such as tetraazaindenes (especially 4-hydroxy-substituted (1,3,3a,7)tetraazaindene); benzenethiosulfonic acids; benzenesulfonic acid; and other compounds which have so far been known as antifoggants or stabilizers can be added to the photographic emulsions.

These antifoggants and stabilizers, though usually added after the chemical sensitization, are preferably added in the course of the chemical ripening, or before the start of the chemical ripening.

The emulsions of this invention can be applied to a photographic light-sensitive material having any layer structure (monolayer or multilayer).

That is, the second and third objects of this invention can be attained by the embodiments described below.

(a) A silver halide photographic material having at least one emulsion layer on a support, with the emulsion layer containing the superfine grain emulsion prepared in accordance with the foregoing method (A) or (B) as at least one constituent light-sensitive silver halide emulsion thereof.

(b) A method of recording holographic images by subjecting the silver halide photographic material of the above-described embodiment (a) to the exposure for holographic image-recording.

(c) A method of recording electron-beam images by irradiating the silver halide photographic material of the above-described embodiment (a) with electron beams.

(d) A method of recording electron-beam images, in which the silver halide photographic material of the above-described embodiment (a) is provided additionally with a conductive layer, and the resulting material is irradiated imagewise with electron beams.

(e) A method of recording high-density images, in which the silver halide photographic material of the above-described embodiment (a) is subjected to scanning exposure to record high-density images therein.

As is apparent from the descriptions concerning the background of this invention, the silver halide photographic material according to the foregoing embodiment (a) has excellent sharpness. The excellent sharpness inherent in the silver halide photographic material of this invention is a property which is independent of exposure method. However, in order for an improvement in sharpness to acquire a practical significance with respect to the recorded images, the recording method itself should have high resolution. Suitable examples of exposure methods for high resolution recording of images include those using light sources of short in wavelength or rich in ultraviolet rays such as mercury lamp (wherein the use of X-rays may be used as light (electromagnetic waves) of shorter wavelengths), those using light sources of strong coherency (lasers or the- like), and exposure with electron beams. Of these methods, the image recording methods according to the above-described embo·liments (b), (c), (d), and (e) are preferred in particular.

In the recording of holographic images, an interference fringe of light which is generated by the interference of light from an object (object wave) with the reference wave is recorded on the surface of a photographic light-sensitive material, and a stereoimage corresponding to the original object wave is reproduced from the recorded interference fringe at the time of image-reproduction. Consequently, the quality of the holographic image depends largely upon how faithfully the photographic light-sensitive material can record the interference fringe of light which is generated in the above-described process. Therefore, an expectation that high sharpness realized with the silver halide photographic material of this invention will be very useful for the recording of holographic images is achieved by the foregoing embodiment (b).

In carrying out the recording of holographic images, one can refer to various books which have been published. For example, one can refer to *Holography no Kiso to Jikken* (which means "Fundamentals and Experiments of Holography"), written by Norimitsu Hirai, compiled by Akira Matsushita, published by Kyoritsu Shuppan in 1979, *Holographic Recording Materials*, edited by H. M. Smith, published by Springer Verlag in 1977, and so on.

The resolving power in recording images with a single light source can be heightened, as described above, by using light of short wavelengths, light of high coherency, or like means. However, resolution finer than the wavelengths of light used cannot be expected so long as light is used, except for special cases utilizing the interference of light, as represented by the holographic image-recording. In addition, various restrictions are placed on light sources for practical use. Consequently, the resolving power realizable in the image-recording with light has its limit in itself. For the purpose of getting over this limit to obtain still higher resolving power, recording images by means of electron beams has been tried. Since the wavelength of electron beams becomes shorter as the acceleration voltage is set higher, the resolving power in the image-recording with electron beams can be heightened with ease, compared with the case of the image-recording with light. However, the use of conventional silver halide photographic materials as a recording medium in the electron-beam recording is apt to be hampered by their own resolving power. Therefore, an expectation that high sharpness realized with the silver halide photographic material of this invention will be very useful for the image-recording with electron beams is achieved the foregoing embodiment (c).

In performing the exposure to electron beams for the purpose of heightening the resolving power, one can refer to the descriptions, e.g., in *Electron Ion Beams Handbook*, 2nd Ed., edited by Nippon Gakujutsu Shinkokai (Committee 132), published by Nippon Kogyo Shinbunsha in 1987. As for the application and the development of this art, though there are few descriptions of the case in which silver halide photographic materials are utilized, one can refer to *Electron-Beam, X-ray, and Ion-beam Technology: Submicrometer Lithographies VIII*, edited by A. W. Yanof, published by SPIE- The International Society for Optical Engineering in 1989, and so on. For the details of the exposure of silver halide photographic materials to electron beams, one can refer to T. H. James, *The Theory of the Photographic Process*, 4th ed., Macmillan Publishing (1977), C. I. Coleman, *J. Phot. Sci.*, Vol. 23, P. 50 (1975), and so on.

According to those descriptions, incident electron beams which permeate into a silver halide photographic material are spread out by scattering due to the presence binder particles and silver halide grains in photographic emulsion layers. Although this phenomenon can be suppressed by reducing the thickness of each emulsion layer to control the drop in resolving power, the reduction in thickness results in a lowering of the proportion of effectively used electrons, that is, a lowering of sensitivity. The degree of spread of electron beams in emulsion layers and the sensitivity of silver halide grains depend largely upon the energy of incident electron beams. Taking into the account the above-described situation in designing silver halide photographic materials, those which satisfy the purpose can be prepared.

On the other hand, though it somewhat differs in standpoint from the above description, the exposure of silver halide photographic materials to electron beams is an effective means in the case where the primary image information is an electric one, such as video signals. For details of the application described above, one can refer to P. F. Grosso, J. P. Whitley and V. P. Morgan, "Electron beam recording for high quality hard copy output" in *Hard Copy Output*, edited by L. Beiser, published by SPIE- The International Society for Optical Engineering in 1989, and so on.

In image-recording with electron beams, electron beams permeating into a recording film in the course of recording lose their energy through the formation of a latent image in the silver halide grains present inside the film and the diffusion throughout the film, and thereby they are converted to low energy electrons. These electrons are gradually accumulated as charges on the film surface and cause the deflection of the succeeding electron beams which are incident on that surface in the recording process, resulting in distortion of the recorded image.

For the purpose of preventing this phenomenon from occurring, and thereby protecting the recorded image against distortion, inventions have been made which involve imparting conductivity to silver halide photographic materials for electron-beam recording to prevent the accumulation of charges. In recording electron-beam images using the silver halide photographic materials in accordance with the embodiment (a) of this invention, it is desirable to employ those inventions in combination. Since the silver halide photographic materials of this invention are relatively low in sensitivity because the silver halide grains therein are fine in size, much exposure tends to be required for effecting the recording of images with electron beams. Such being the case, it has turned out that an especially desirable effect can be produced by providing the photographic materials of this invention with a conductive layer. Thus, the foregoing embodiment (d) of this invention has been developed. As for a particular way to make a conductive layer, one can refer to the descriptions in U.S. Pat. No. 3,336,596, British Patent 1,340,403, JP-B-49-24282, JP-A-64-70742 and references cited therein.

The relatively low sensitivity inherent in the silver halide photographic material of this invention due to the fineness of its silver halide grains in size, as described hereinbefore, implies that a relatively large quantity of exposure is required for recording images with light. In recording images on the order of several microns to submicrons in high density, not only pattern exposure through a mask but also scanning exposure which enables precise control of the image-recording is carried out advantageously. Though both exposure methods are applicable to the silver halide photographic materials of this invention, it has been found by the inventors of this invention that the latter scanning exposure is preferred in particular when the silver halide photographic -materials of this invention are employed.

The reasons for the preference of the scanning exposure are as follows. The recording of images through scanning exposure is carried out by making a fine spot-form luminous flux move on a recording medium, so the residence time of the luminous flux at each exposed spot is short. In addition, an exposure greater than some definite value is reuired for sensitizing silver halide grains. In the scanning exposure, therefore, the illuminance at the exposed spot is generally set to a high intensity in order to ensure the necessary exposure to the recording medium in a short time. As a result of our examinations, it has been found that in the high-intensity short-time exposure as described above, sensitivity drop caused by the use of the silver halide photographic materials of this invention is relatively small. It can be regarded as a cause of the small drop in sensitivity that though the sensitivity of the silver halide grains of this invention is low because of their small size, the smallness in grain size lessens the probability of latent-image dispersion, which has a tendency to occur in high intensity exposure. Moreover, a low probability of light-scattering, which is a characteristic of the silver halide photographic materials of this invention, as described in the foregoing "Background of the Invention", makes it hard for spots actually recorded on the recording medium to be extended in size through the irradiation inside the recording medium (that is, changes in scattering behavior of light which is caused by the variation in incident angle of the recording spot on the recording medium), and like ones. Therefore, this characteristic also is useful in particular for high density recording by means of scanning exposure. Thus, the foregoing embodiment (e) of this invention has been developed.

Since high resolving power is an important characteristic of the silver halide photographic materials of this invention, the preparation and handling of the photographic materials must be carried out with caution so as not to adversely affect that characteristic. For instance, caution must be employed such that factors constituting obstacles to the writing and reading of image information, such as foreign matter like dust, scratches on the surface and so on, are removed in every way, or the writing and reading of image information is carried out in liquid having a refractive index close to that of the photographic material in order to exclude influences of external disturbance, e.g., dust, reflection, etc. Moreover, as for the method of preventing the image information from being altered in the course of development processing, experimental arts cultivated for the purpose of analyzing tracks of elementary particles, such as nuclear emulsions, serve as especially influential references. An example of such a reference is the above-cited paper, C. I. Coleman, *J. Photo. Sci.*, Vol. 23, p. 50 (1975).

On the other hand, in the case where flatness of the recording medium constitutes an important factor in recording and reproducing images, as in holographic image recording, caution as to the use of a support having only slight distortion, such as glass, should be taken, if needed.

A silver halide multilayer color photographic material utilizing the emulsion prepared in accordance with this invention has a multilayer structure in which three kinds of emulsions for recording blue, green and red rays separately are consecutively layered, wherein each layer contains a binder and silver halide grains. Each emulsion layer has at least two constituent layers (a high sensitivity layer and a low sensitive layer).

The silver halide emulsions of this invention can be applied not only color photographic materials, as described above, but also to other photographic materials, irrespective of the number of emulsion layers they have, with specific examples including X-ray sensitive materials, black-and-white photosensitive materials, photosensitive materials for plate-making, photographic paper, and so on.

The silver halide emulsions of this invention do not have any particular limitation as to additives (including binders, chemical sensitizers, spectral sensitizers, stabilizers, gelatin hardeners, surfactants, antistatic agents, polymer latexes, matting agents, color couplers, ultraviolet absorbents, discoloration inhibitors and dyes), supports, coating methods, exposure methods and development-processing methods of the photographic materials using these emulsions. For details with respect to the additives, one can refer to the descriptions, e.g., in *Research Disclosure*, Vol. 176, Item 17643 (RD-17643), ibid., Vol. 187, Item 18716 (RD-18716), and ibid., Vol. 225, Item 22534 (RD-22534), as set forth below.

| Kind of Additives | RD 17643 | RD 18716 | RD 22534 |
|---|---|---|---|
| 1. Chemical Sensitizers | Page 23 | Page 648, right column | Page 24 |
| 2. Sensitivity Increasing Agents | | Page 648, right column | |
| 3. Spectral Sensitizers and Supersensitizers | Pages 23 to 24 | Page 648, right column to page 649, right column | Page 24 to 28 |
| 4. Brightening Agents | Page 24 | | |
| 5. Antifoggants and Stabilizers | Pages 24 to 25 | Page 649, right column | Page 24 and 31 |
| 6. Light-Absorbers, Filter Dyes and UV Ray Absorbers | Pages 25 to 26 | Page 649, right column to page 650, left column | |
| 7. Stain Inhibitors | Page 25, right column | Page 650, left column to right column | |
| 8. Dye Image Stabilizers | Page 25 | | Page 32 |
| 9. Hardeners | Page 26 | Page 651, left column | Page 28 |
| 10. Binders | Page 26 | Page 651, left column | |
| 11. Plasticizers and Lubricants | Page 27 | Page 650, right column | |
| 12. Coating Aids and Surfactants | Pages 26 to 27 | Page 650, right column | |
| 13. Antistatic Agents | Page 27 | Page 650, right column | |
| 14. Color Couplers | Page 25 | Page 649 | Page 31 |

The couplers to be used in this invention should desirably be rendered nondiffusible through the use of a hydrophobic group functioning as a ballast group, or by assuming a polymerized form. Further, two-equivalent couplers which have a coupling group to be eliminated at their coupling active site are preferred to four-equivalent ones which have a hydrogen atom at their coupling site from the standpoint of reduction in silver coverage. Furthermore, couplers which can form dyes of moderate diffusibility, colorless couplers, couplers capable of releasing a development inhibitor upon development (so-called DIR couplers) or couplers capable of releasing a development accelerator upon development can be also used.

Typical examples of yellow couplers which can be used in this invention include oil-protected acylacetamide couplers.

Such couplers are represented by yellow couplers having a splitting-off group of the type which is attached to the coupling active site via its oxygen or nitrogen atom. The α-pivaloylacetanilide type couplers are excellent in fastness of the colored dyes, particularly in the light fastness thereof, and the α-benzoylacetanilide type couplers generally form dyes of high color density.

Magenta couplers which can be used in this invention include oil-protected indazolone or cyanoacetyl couplers, preferably those of the 5-pyrazolone type and those of the pyrazoloazole type, such as pyrazolotriazoles. Among the 5-pyrazolone type couplers, those in which the 3-position is sustituted by an arylamino or acylamino group are preferred from the viewpoint of the hue or the color density of the colored dyes.

Imidazo[1,2-b]pyrazoles disclosed in U.S. Pat. No. 4,500,630 are favored because of the lower yellow side absorption of the colored dyes and the light fastness thereof, and those particular preferred in these respects are the pyrazolo[1,5-b][1,2,4]triazoles disclosed in U.S. Pat. No. 4,540,650.

Cyan couplers which can be used in this invention include oil-protected naphthol and phenol couplers. Preferred cyan couplers include the naphthol couplers disclosed in U.S. Pat. No. 2,474,293, and especially preferred ones are two-equivalent naphthol couplers having a splitting-off group of the type which is attached to the coupling active site via its oxygen atom, as disclosed in U.S. Pat. Nos. 4,052,212, 4,146,396, 4,228,233 and 4,296,200.

Naphthol couplers in which the 5-position is substituted by a sulfonamido group, an amido group or the like (as disclosed in JP-A-60-237448, JP-A-61-153640, JP-A-61-145557) are preferably used in this invention because of excellence in fastness of the developed color images.

Couplers which form dyes with an appropriate diffusibility can be used additionally for the purpose of improving graininess. As for the couplers of this kind, examples of magenta couplers are disclosed in U.S. Pat. No. 4,336,237 and British Patent 2,125,570, and those of yellow, magenta and cyan couplers are disclosed in European Patent 96,570 and German Patent (OLS) No. 3,234,533.

Couplers releasing a development inhibitor with the progress of development, or DIR couplers, may be incorporated in the emulsions of this invention.

The DIR couplers which are preferred in combination with this invention include DIR couplers which deactivate a developer, as disclosed in JP-A-57-151944; DIR couplers of the timing type, as disclosed in U.S. Pat. No. 4,248,962 and JP-A-57-154234; and DIR couplers of the reacting type, as disclosed in JP-A-60-18428. Especially favored ones among the DIR couplers of the above-cited types are those of the developer deactivating type, as disclosed, e.g., in JP-A-57-151944, JP-A-58-217932, JP-A-60-218644, JP-A-60-225156 and JP-A-60-233650; and those of the reacting type, as disclosed, e.g., in JP-a-60-184248.

Compounds releasing imagewise a nucleating agent, or a development accelerator or a precursor thereof (hereinafter abbreviated as "development accelerator or the like") upon development can be used in the photographic materials of this invention. Typical examples of such compounds are given in British Patents 2,097,140 and 2,131,188, and include couplers releasing a development accelerator or the like by the coupling reaction with an oxidized aromatic primary amine developer, or DAR couplers.

Suitable examples of high boiling organic solvents to be used for the dispersion of color couplers include phthalic acid esters (such as dibutyl phthalate, dicyclohexyl phthalate, di-2-ethylhexylphthalate, decyl phthalate, etc.), phosphoric or phosphonic acid esters (such as triphenyl phosphate, tricresyl phosphate, 2-ethylhexyl diphenyl phosphate, tricyclohexyl phosphate, tri-2-ethylhexyl phosphate, tridecyl phosphate, tri-butoxyethyl phosphate, trichloropropyl phosphate, di-2-ethylhexyl phenyl phosphate, etc.), benzoic acid esters (such as 2-ethylhexylbenzoate, dodecylbenzoate, 2-ethylhexyl-p-hydroxybenzoate, etc.), amides (such as diethyldodecanamide, N-tetradecylpyrrolidone, etc.), alcohols or phenols (such as isostearyl alcohol, 2,4-di-tert-amylphenol, etc.), aliphatic carboxylic acid esters (such as dioctylazelate, glycerol tributyrate, iso-stearyl lactate, trioctyl tosylate, etc.), aniline derivatives (such as N,N-dibutyl-2-butoxy-5-tert-octylaniline, etc.), hydrocarbons (such as paraffin, dodecylbenzene, diisopropylnaphthalene, etc.), and so on. In addition, organic solvents having a boiling point of about 30° C. or above, preferably from 50° C. to about 160° C., can be used as auxiliary solvents. Typical examples of auxiliary solvents include ethyl acetate, butyl acetate, ethyl propionate, methyl ethyl ketone, cyclohexanone, 2-ethoxyethyl acetate, dimethylformamide, and so on.

As for the gelatin hardener, active halogen-containing compounds (e.g., 2,4-dichloro-6-hydroxy-1,3,5-triazine and the sodium salt thereof) and active vinyl compounds (e.g., 1,3-bisvinylsulfonyl-2-propanol, 1,2-bis(-vinylsulfonylacetamide)ethane, vinyl polymers having vinylsulfonyl group in their side chains) are preferred, because they can harden rapidly hydrophilic colloids such as gelatin to ensure stable photographic characteristics. Also, N-carbamoylpyridinium salts (e.g., 1-morpholinocarbonyl-3-pyridinio methanesulfonate) and haloamidinium salts (e.g., 1-(1-chloro-1-pyridinomethylene)pyrrolidinium 2-naphthalenesulfonate) are excellent because of their high hardening speeds.

After development and subsequent bleach-fix or fixation processing, color photographic materials using the silver halide photographic emulsions of this invention are generally subjected to a washing or stabilization processing.

In general, the washing step is performed in accordance with a counter-current method using two or more processing tanks for the purpose of saving water. On the other hand, the stabilization step can be performed instead of the washing step, in which a multistage counter current stabilization method as described in JP-A-57-8543 can be used typically.

The color developer to be used in the development processing of the photographic materials of this invention is preferably an alkaline aqueous solution containing as a main component an aromatic primary amine developing agent. As for the color developing agent, p-phenylenediamine compounds are preferably used, although aminophenol compounds are also useful. Typical examples of p-phenylenediamine type developing agents include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides or p-toluenesulfonates of the above-cited agents. These compounds can be used in combination with two or more thereof, if desired.

In carrying out reversal processing, black and white development is generally succeeded by color development. For the black and white developer, dihydroxybenzenes such as hydroquinone, 3-pyrazolidones such as 1-phenyl-3-pyrazolidone, aminophenols such as N-methyl-p-aminophenol, and other known black-and-white developing agents can be used alone or as a mixture of two or more thereof.

In general, the pH of these color developers and black and white developers is within the range of 9 to 12. Each of these developers is supplied with not more than 3 l portions of a replenisher per $m^2$ of photographic materials processed therein. In the case where the replenisher has a reduced bromine ion concentration, the replenishing amount can be lowered to 500 ml or less.

The photographic emulsion layers are generally subjected to bleach-processing after the color development. The bleach-processing may be carried out simultaneously with fixation-processing (bleach-fix processing), or separately .therefrom. For the purpose of further increasing the photographic processing speed, the bleach-processing may be succeeded by bleach-fix processing. As a bleaching agent, aminopolycarboxylic acid-Fe(III) complex salts are particularly useful .in both the bleaching bath and bleach-fix bath. The pH of the bleaching or bleach-fix bath using an aminopolycarboxylic acid-Fe(III) complex salt generally ranges from 5.5 to 8. However, these processing baths may be adjusted to a still lower pH in order to increase the processing speed.

In the bleaching bath, the bleach-fix bath and the prebaths thereof, a bleach accelerator can be used, if needed. As useful bleach accelerators, compounds containing a mercapto group or a disulfide linkage are preferred because of their great effect. Of such compounds, those disclosed in U.S. Pat. No. 3,893,858, German Patent 1,290,812 and JP-A-53-95630 are favored in particular. In addition, the compounds disclosed in U.S. Pat. No. 4,552,834 are also advantageous. These bleach accelerators may be incorporated into photographic materials.

The silver halide color photographic materials of this invention, as described above, are generally subjected to washing and/or stabilization processing after the desilvering processing. The volume of washing water to be used in the washing processing can be chosen from a wide range because it depends on characteristics of the photographic materials to be washed (e.g., whether couplers are incorporated therein, or not), the end-use purpose of the photographic materials to be washed, the temperature of the washing water, the number of washing tanks (the number of washing stages), the method for replenishing the washing water (e.g., whether the method for washing stages is counter current or not), and other various conditions. Among these conditions, the relationship between the numer of washing tanks and the water volume can be determined in accordance with the method described in *Journal of the Society of Motion Picture and Television Engineers*, vol. 64, pp. 248–253 (May 1955).

This invention will be illustrated in greater detail by reference to the following examples. However, the invention should not be construed as being limited to these examples. All parts, percents, and ratios are by weight unless otherwise indicated.

EXAMPLE 1

Protective Colloid Polymer:

The protective colloids employed in this example are cited below.

Alkali-processed ossein gelatin
(weight average molecular weight: 100,000)

Low molecular weight gelatin
(weight average molecular weight: 10,000)

-continued

Polyvinyl alcohol P-3

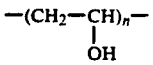

(weight average molecular weight: 70,000)

Vinyl polymer containing azaindenyl groups P-4

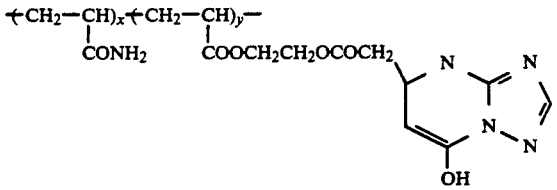

x:y = 80:20
(weight average molecular weight: 60,000)

1-Vinyl-2-methylimidazole polymer P-5

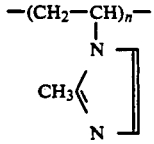

(weight average molecular weight: 20,000)

Copolymer of acrylamide and 1-vinyl-2-methyl-imidazole P-6

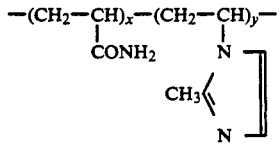

x:y = 90:10
(weight average molecular weight: 50,000)

Vinyl polymer containing thioether groups P-7

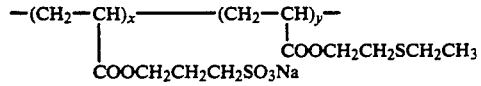

x:y = 3:1
(weight average molecular weight: 70,000)

Polyvinyl pyrrolidone P-8

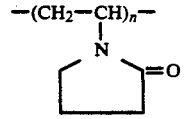

(weight average molecular weight: 50,000)

Copolymer of vinyl alcohol and vinyl pyrrolidone P-9

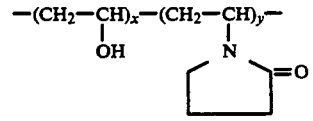

x:y = 40:60
(weight average molecular weight: 60,000)

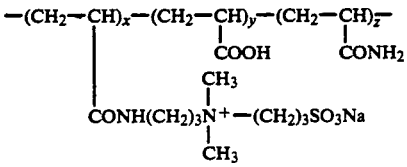

x:y:z = 4:10:86
(weight average molecular weight: 60,000)

Superfine Grain Silver Bromide Emulsion (1-A) <Comparison>

600 ml of an aqueous solution containing 100 g of silver nitrate, 600 ml of an aqueous solution containing 72 g of potassium bromide and 2,400 ml of a 3 wt % aqueous solution of the foregoing gelatin P-1 were injected at a uniform speed into a mixing device as shown in FIG. 1 over a 150-minute period in accordance with the triple jet method. The gelatin had a physical retardativity value of 12. The residence time of the injected solutions in the mixing device was 10 seconds. The agitation impeller was rotated at a speed of 1,000 r.p.m. The average size of the fine grains of silver bromide expelled from the mixing vessel was determined to be 0.03 μm by observation with a direct transmission electron microscope of 20,000 magnification. The temperature inside the mixing device was kept at 35° C., and the fine grains formed in the mixing vessel were introduced continuously into a collection vessel. At the conclusion of the collection, the obtained superfine grain emulsion was heated up to 50° C and kept for 60 minutes. Again, the grain size of the thus ripened emulsion was examined by means of the direct transmission electron microscope of 20,000×magnification. Thereby, it was determined that the average grain size increased to 0.055 μm.

Silver Bromide Superfine Grains (1-B) <Comparison>

Another preparation was tried under the same conditions as were used with the preparation of the foregoing emulsion (1-A), except the temperature in the mixing device was set at 20° C. However, fine grain formation ended in a failure because of the gelation of the gelatin solution in the mixing device, which was caused by setting the temperature in the mixing device at 20° C. More specifically, it is necessary to lower the temperature in the mixing device, for the formation of fine grains with a still smaller size, but the formation of fine grains has nevertheless turned out to be impossible so long as the gelatin P-1 was used as protective colloid.

Silver Bromide Superfine Grains (1-C) <Comparison>

Instead of using the gelatin P-1, the foregoing low molecular weight gelatin P-2 was used as protective colloid in preparing another emulsion under the same conditions as were used in the preparation of emulsion (1-B). The low molecular weight gelatin had a physical retardativity value of 7. The solution of the gelatin P-2 did not gel at all under a temperature of 20° C., and enabled the formation of superfine grains.

Superfine Grain Silver Bromide Emulsions (1-D) to (1-K)

Emulsions from (1-D) to (1-K) were prepared under the same conditions as described above (wherein a temperature of the mixing device was set at 20° C.), except the synthetic polymers of this invention, from P-3 to P-10, functioning as protective colloid, were used respectively instead of the foregoing gelatins.

Fine Grain Silver Bromide Emulsion (1-L) <Comparison>

1,500 ml of water and 35 g of the gelatin P-1 were placed in a reaction vessel, and stirred vigorously. 600 ml of an aqueous solution containing 100 g of silver nitrate and 600 ml of an aqueous solution containing 75 g of potassium bromide were added simultaneously to the stirred gelatin solution at a uniform speed over a 50-minute period under a silver potential of +40 mV (relative to a saturated calomel electrode) in accordance with the controlled double jet method. The reaction vessel was kept at 35° C. The grain size just after the conclusion of the addition was 0.05 μm. The temperature of the reaction vessel was raised to 50° C. at the conclusion of the addition, and kept there for 60 minutes. Thus, the grain size increased to 0.06 μm.

The conditions and results of the above-described emulsion grain formation are summarized below in Table 1.

TABLE 1

| Emulsion | Protective Colloid | Temp. of Mixing Device (°C.) | Average Grain Size Just after Expulsion from Mixing Device (μm) | Average Grain Size after 60-minute Lapse at 50° C. (μm) | Note |
|---|---|---|---|---|---|
| 1-A | P-1 | 35 | 0.03 | 0.06 | Comparison |
| 1-B | " | 20 | — | — | " |
| 1-C | P-2 | " | 0.015 | 0.06 | " |
| 1-D | P-3 | " | 0.01 | 0.01 | Invention |
| 1-E | P-4 | " | 0.015 | 0.02 | " |
| 1-F | P-5 | " | 0.01 | 0.01 | " |
| 1-G | P-6 | " | 0.015 | 0.02 | " |
| 1-H | P-7 | " | 0.015 | 0.015 | " |
| 1-I | P-8 | " | 0.01 | 0.01 | " |
| 1-J | P-9 | " | 0.01 | 0.01 | " |
| 1-K | P-10 | " | 0.02 | 0.03 | " |
| 1-L | P-1 | 35 | 0.05* | 0.06 | Comparison |

*The average size of the grains present in the reaction vessel just after the conclusion of the addition.

All of the protective colloids from P-3 to P-10 had physical retardance values of 40 or more, whereas the physical retardance values of the gelatin P-1 and the gelatin P-2 were 12 and 7, respectively.

In the cases where the alkali-processed gelatin P-1 and the low molecular weight gelatin P-2 were used, superfine grain emulsions with sizes of 0.03 μm and 0.015 μm respectively were obtained just after the expulsion from the mixing device, but these average grain sizes both increased to 0.06 μm by the 60-minute aging process at 50° C. This result implies that in the lapse of time required for washing, redispersion, chemical sensitization, storage, redissolution and solution of the emulsion, which are all essential steps in preparation of a photographic material, an increase in grain size takes place to make it impossible to obtain a photographic material containing superfine grains. On the other hand, the emulsions of this invention, from (1-D) to (1-K), had either no increase at all in grain size or only a very slight increase in grain size. Therefore, it is apparent that materials containing superfine grain emulsions can be prepared with this invention. Also, it is apparent from the result of emulsion (1-L) that according to the conventional method of not using any mixing device, the grain growth which took place failed to provide superfine grains.

EXAMPLE 2

Superfine Grain Silver Chloride Emulsion (2-1) <Comparison>

400 ml of an aqueous solution containing 100 g of silver nitrate, 400 ml of an aqueous solution containing 36 g of sodium chloride and 1,600 ml of a 3 wt % aqueous solution of the foregoing ossein gelatin P-1 were injected at a uniform speed into a mixing device as shown in FIG. 1 over a 100-minute period in accordance with the triple jet method. The gelatin had a physical retardativity value of 12. The residence time of the injected solutions in the mixing device was 10 seconds. The agitation impeller was rotated at a speed of 1,500 r.p.m. The average size of the fine grains of silver chloride expelled from the mixing vessel was determined to be 0.05 μm by observation with a direct transmission electron microscope of 20,000×magnification. The temperature inside the mixing device was kept at 30° C., and the fine grains formed in the mixing vessel were introduced continuously into a collection vessel. At the conclusion of the addition, the obtained superfine grain emulsion was heated up to 50° C. and kept at that temperature for 60 minutes. The grain size of the thus ripened emulsion was examined by means of the direct transmission electron microscope of 20,000×magnification. Thereby, it was determined that the average grain size increased to 0.11 μm.

Silver Chloride Superfine Grain Emulsion (2-2) <Comparison>

Another preparation was tried under the same conditions as were used with the preparation of the foregoing emulsion (2-1), except the temperature in the mixing device was set at 18° C. However, fine grain formation ended in a failure because of the gelation of the gelatin solution in the mixing device, which was caused by setting the temperature in the mixing device at 18° C. More specifically, it is necessary to lower the temperature in the mixing device, for the formation of fine grains with a still smaller size, but the formation of fine grains has nevertheless turned out to be impossible so long as the gelatin P-1 was used as protective colloid.

Silver Chloride Superfine Grain Emulsion (2-3) <Comparison>

Instead of using the gelatin P-1, the foregoing low molecular weight gelatin P-2 was used as the protective colloid in preparing another emulsion under the same conditions as were used in the preparation of emulsion (2-2). The low molecular weight gelatin had a physical retardativity value of 7. The solution of the gelatin P-2 did not gel at all under a temperature of 18° C., and enabled the formation of superfine grains.

Silver Chloride Superfine Grain Emulsion (2-4) <Invention>

Still another emulsion was prepared in the same manner as emulsion (2-1) was prepared, except 0.012 mol of the grain-growth retarder I-1 was added to 1,600 ml of the 3 wt % aqueous solution of the ossein gelatin P-1.

Silver Chloride Superfine Grain Emulsions (2-5) to (2-13) <Invention>

Emulsions relating to this invention, identified as emulsions (2-5) to (2-13), were prepared under the same conditions as described above (wherein the temperature in the mixing device was set at 30° C.), except the grain-growth retarder I-1 was replaced by the grain-growth retarders shown in Table 2, respectively.

Silver Chloride Superfine Grain Emulsion (2-14) <Invention>

An emulsion was prepared in the same manner as the emulsion (2-3), except 0.012 mol of the grain-growth retarder I-1 was additionally contained in 1,600 ml of the low molecular weight gelatin (P-2) solution.

Silver Chloride Superfine Grain Emulsions (2-15) to (2-23) <Invention>

Emulsion relating to this invention, identified as emulsions (2-15) to (2-23), were prepared under the same conditions as described above (wherein a temperature of .the mixing device was set at 18° C.), except the grain-growth retarder I-1 was replaced by the grain-growth retarders shown in Table 2, respectively.

Silver Chloride Fine Grain Emulsion (2-24) <Comparison>

1,500 ml of water and 35 g of the gelatin P-1 were placed in a reaction vessel, and stirred vigorously. 600 ml of an aqueous solution containing 100 g of silver nitrate and 600 ml of an aqueous solution containing 75 g of sodium chloride were added simultaneously to the stirred gelatin solution at a uniform speed over a 50-minute period under a silver potential of +190 mV (relative to a saturated calomel electrode) in accordance with the controlled double jet method. The reaction vessel was kept at 30° C. The grain size just after the conclusion of the addition was 0.08 μm. The temperature of the reaction vessel was raised to 50° C. at the conclusion of the addition and kept there for 20 minutes. Thus, the grain size increased to 0.11 m.

The conditions and results of the above-described emulsion grain formation are summarized below in Table 2.

TABLE 2

| Emulsion | Grain Growth Retarder | Temp. of Mixing Device (°C.) | Average Grain Size Just after Expulsion from Mixing Device (μm) | Average Grain Size after 60-minute Lapse at 50° C. (μm) | Note |
|---|---|---|---|---|---|
| 2-1 | — | 30 | 0.05 | 0.11 | Comparison |
| 2-2 | — | 18 | — | — | " |
| 2-3 | — | " | 0.025 | 0.11 | " |
| 2-4 | I-1 | 30 | 0.04 | 0.04 | Invention |
| 2-5 | I-7 | " | " | " | " |
| 2-6 | I-9 | " | 0.05 | 0.05 | " |
| 2-7 | I-15 | " | " | 0.05 | " |
| 2-8 | I-22 | " | 0.04 | 0.04 | " |
| 2-9 | II-2 | " | 0.05 | 0.05 | " |
| 2-10 | II-5 | " | " | 0.05 | " |
| 2-11 | II-12 | " | 0.05 | 0.05 | " |
| 2-12 | II-23 | " | " | " | " |
| 2-13 | III-1 | " | 0.05 | 0.05 | " |
| 2-14 | I-1 | 18 | 0.015 | 0.015 | " |
| 2-15 | I-7 | " | " | " | " |
| 2-16 | I-9 | " | 0.03 | 0.03 | " |
| 2-17 | I-15 | " | 0.02 | 0.02 | " |
| 2-18 | I-22 | " | 0.02 | 0.025 | " |
| 2-19 | II-2 | " | 0.025 | 0.03 | " |
| 2-20 | II-5 | " | " | 0.025 | " |
| 2-21 | II-12 | " | 0.02 | 0.025 | " |
| 2-22 | II-23 | " | " | " | " |
| 2-23 | III-1 | " | 0.025 | 0.03 | " |
| 2-24 | — | 30 | 0.08* | 0.11 | Comparison |

*The average size of the grains present in the reaction vessel just after the conclusion of the addition.

All of the grain-growth retarders of this invention had physical retardance values of 50 or more, whereas the physical retardance values of the gelatin P-1 alone and the gelatin P-2 alone were 12 and 7, respectively.

Even in the cases where any grain-growth retarder was not used, superfine silver chloride grains were obtained just after the expulsion from the mixing device, particularly in the case where the temperature in the mixing device was low, but the average grain size increased to 0.06 μm in every case by the 20-minute aging process at 50° C. This result implies that in the lapse of time required for washing, redispersion, storage, redissolution and solution of the emulsion, which are all essential steps in preparation of a photographic material, an increase in grain size takes place to make it impossible to obtain a photographic material containing superfine grains. On the other hand, all the emulsions of this invention, from (2-4) to (2-13) (mixing device temperature: 30° C.) and from (2-14) to (2-23) (mixing device temperature: 18° C.), had either no increase at all in grain size or only a very slight increase in grain size. Therefore, it is apparent that materials containing superfine grain emulsions can be prepared with this invention. Also, it is apparent from the result of emulsion (2-24) that according to the conventional method of not using any mixing device, the grain growth which took place failed to provide preparing superfine grains.

EXAMPLE 3

Silver Bromide Superfine Grain Emulsion (3-A) <Invention>

Superfine grains were formed in the same manner as those of silver bromide emulsion (1-C) in Example 1, except 0.013 mol of a sensitizing dye (IV-5) was additionally contained in 2,400 ml of a 3 wt % of aqueous solution of the protective colloid P-2 (mixing device temperature: 20° C.).

Other emulsions, identified as (3-B) to (3-F), were prepared under the same conditions as described above, except the sensitizing dye IV-5 was replaced by sensitizing dyes set forth in Table 3. The conditions under which grains of each emulsion grew, and the result therefrom, are shown in Table 3.

TABLE 3

| Emulsion | Sensitizing Dye | Temp. of Mixing Device (°C.) | Average Grain Size Just after Expulsion from Mixing Device (μm) | Average Grain Size after 60-minute Lapse at 50° C. (μm) | Note |
|---|---|---|---|---|---|
| 1-C | — | 20 | 0.015 | 0.06 | Comparison |
| 3-A | IV-5 | " | 0.015 | 0.02 | Invention |
| 3-B | IV-9 | " | 0.015 | 0.015 | " |
| 3-C | IV-10 | " | 0.015 | 0.015 | " |
| 3-D | IV-31 | " | 0.01 | 0.01 | " |
| 3-E | V-5 | " | 0.01 | 0.01 | " |
| 3-F | V-12 | " | 0.01 | 0.015 | " |

All of the sensitizing dyes used herein had a physical retardance value of 40 or more.

As can be seen from Table 3, the superfine grains with an average size of 0.015 μm were obtained even in the absence of any sensitizing dye just after the expulsion from this mixing device, but the grains formed under the condition markedly increased in size to 0.06 μm by the 60-minute aging process at 50° C. This result implies that in the lapse of time required for washing, redispersion, chemical sensitization, storage, redissolution and solution of the emulsion, which are all essential steps in preparation of a photographic material, an increase in grain size takes place to make it impossible to obtain a photographic material containing superfine grains. On the other hand, the emulsions of this invention, from (3-A) to (3-F), had either no increase at all in grain size or only a very slight increase in grain size. Therefore, it .is apparent that materials containing superfine grain emulsions can be prepared with this invention.

EXAMPLE 4

Superfine grain emulsions were prepared by a process which comprised forming superfine grains in a mixing device, continuously expelling the formed superfine grain emulsion from the mixing device, and adding a protective colloid polymer or grain-growth retarder satisfying the requirement of this invention to the emulsion just after the expulsion.

More specifically, as shown in FIG. 2, superfine grains were formed in the first mixing device and immediately introduced into the second mixing device (having the same structure as shown in FIG. 2). A protective colloid polymer capable of retarding the grain-growth or a grain-growth retarder was added to the second mixing device concurrently with the introduction of the superfine grains, and mixed with the emulsion therein. The resulting mixture was expelled from the second mixing device and introduced into a collection vessel.

The compounds used in this example are illustrated below.

Silver Chloride Superfine Grain Emulsions (4-1) to (4-3)

Silver chloride superfine grain emulsions were formed in the same manner as the superfine grain emulsion (2-3) in Example 2 (mixing device temperature: 18° C.), and each emulsion expelled from the mixing device was injected into the second mixing device in less than 10 seconds. 400 ml of a 10 wt % aqueous solution of the polymer P-3 was added to the second mixing device at a uniform speed concurrently with the injection of the emulsion, over a 100-minute period to prepare an emulsion (4-1).

Emulsions (4-2) and (4-3) were prepared in the same manner as described above, except the polymers P-5 and P-8 were used in the place of the polymer P-3.

Silver Chloride Superfine Grain Emulsions (4-4) to (4-11)

An emulsion (4-4) was prepared in the same manner as the foregoing emulsion (4-1), except 100 ml of a solution containing 0.012 mol of the grain-growth retarder I-1 instead of the foregoing polymer solution was added to the second mixing device at a uniform speed over a 100-minute period.

Further, emulsions from (4-5) to (4-11) were prepared in the same manner as described above, except that the grain-growth retarders set forth in Table. 4 were used in the place of the grain-growth retarder I-1, respectively.

At the conclusion of the addition, the temperature of each emulsion was raised to 50° C. and kept there for 60 minutes. Grain sizes were measured just after the expulsion from the second mixing device and after the 60-minute aging process at 50° C. The results obtained are shown in Table 4.

TABLE 4

| Emulsion | Additive | Temp. of 1st Mixing Device (°C.) | Grain Size Just after Expulsion from 2nd Mixing Device (μm) | Grain Size after 60-minute Lapse at 50° C. (μm) | Note |
|---|---|---|---|---|---|
| 4-1 | P-3 | 18 | 0.025 | 0.025 | Invention |

TABLE 4-continued

| Emulsion | Additive | Temp. of 1st Mixing Device (°C.) | Grain Size Just after Expulsion from 2nd Mixing Device (μm) | Grain Size after 60-minute Lapse at 50° C. (μm) | Note |
|---|---|---|---|---|---|
| 4-2 | P-5 | " | " | 0.025 | " |
| 4-3 | P-8 | " | " | 0.03 | " |
| 4-4 | I-1 | " | " | 0.025 | " |
| 4-5 | I-7 | " | " | 0.03 | " |
| 4-6 | II-5 | " | " | 0.025 | " |
| 4-7 | II-23 | " | " | 0.025 | " |
| 4-8 | IV-9 | " | " | 0.03 | " |
| 4-9 | IV-31 | " | " | 0.035 | " |
| 4-10 | V-5 | " | " | 0.025 | " |
| 4-11 | V-12 | " | " | 0.025 | " |
| 2-3 | — | " | 0.025* | 0.11 | Comparison |

*Grain size just after the expulsion from the first mixing device for grain formation.

As can be seen from Table 4, the emulsion (2-3) presented for comparison had a very small grain size of 0.025 μm just after the expulsion from the first mixing device for grain formation, but the grain size increased to 0.11 μm by the 60-minute aging process at 50° C. This result implies that in the lapse of time required for washing, redispersion, storage, redissolution, chemical sensitization, and dissolution of the emulsion, which are all essential steps in preparation of a photographic material, an increase in grain size takes place to make it impossible to obtain a photographic material containing superfine grains. On the other hand, the present emulsions, from (4-1) to (4-11) (mixing device temperature: 18° C.), had either no increase at all in grain size or only a very slight increase in grain size. Therefore, it is apparent materials containing superfine grain emulsions can be prepared with this invention.

EXAMPLE 5

Silver halide photographic materials were prepared by a process which comprised forming superfine grains in a first mixing device, expelling the formed grains continuously from the mixing device, immediately adding a sensitizing dye satisfying the requirement of this invention to the expelled grains, and coating the thus obtained superfine grain emulsion on a support. That is, the superfine grain emulsion was prepared in the same manner as in Example 4.

In this example, the preparation of silver halide photographic materials using the superfine grain emulsions made in the above-described process and image forming methods using these photographic materials were examined.

By analogy with the silver bromide superfine grains (1-C) described in Example 1, an emulsion having an average grain size of 0.015 μmm just after the expulsion from the mixing device was prepared as follows: 600 ml of an aqueous solution containing 100 g of silver nitrate, 600 ml. of an aqueous solution containing 72 g of potassium bromide and 2,400 ml of a 3 wt% aqueous solution of the low molecular weight gelatin P-2 were injected simultaneously into the mixing device as shown in FIG. 1 at a uniform speed over a 150-minute period in accordance with the triple jet method (residence time of each injected solution in the mixing device: 10 seconds; rotation speed of the agitation impeller: 1,000 r.p.m.; mixing device temperature: 20° C.). The superfine grains expelled from the mixing device were immediately introduced into the second mixing device (as shown in FIG. 3) and, at the same time, were mixed with a methanol solution containing a sensitizing dye capable of retarding the grain growth.

More specifically, 500 ml of a mixture containing a superfine grain emulsion with a grain size cf 0.015 μm (containing 0.082 mol of silver bromide) was added to 1,600 ml of a stirred methanol solution of the sensitizing dye IV-9 (sensitizing dye concentration: 0.002M). The gelatin condensed immediately upon mixing to result in the generation of turbidity, so the stirring was stopped. The precipitates were generated while the mixture was left standing, and the supernatant thereof was removed to effect desalting and condensation.

5 g of an alkali-processed gelatin P-1, a surfactant, a hardener and antiseptics were added to the thus obtained precipitates. Water was added thereto in such an amount as to adjust the total volume to 100 ml. Then, the mixture was stirred while being heated at 50° C. for homogeneous dispersion. Further, the obtained dispersion was kept at 40° C. and coated on a cellulose triacetate film provided with a subbing layer so that the resulting layer had a thickness of 7 μm and a silver coverage of 5 g/m$^2$.

Thus, a silver halide photographic material was produced, and it was named Sample (5-2). Another sample (5-1) was prepared in the same manner as sample (5-2), except the sensitizing dye IV-9 was not used. In addition, other samples (5-3), (5-4) and (5-5) were prepared in the same manner as sample (5-2), except the sensitizing dye IV-9 was replaced by the sensitizing dyes IV-31, V-5 and V-12, respectively, in the corresponding amounts. Also, samples for comparison, (5-12), (5-13), (5-14) and (5-15), were prepared in the same manner as sample (5-1), except the sensitizing dyes IV-9, IV-31, V-5 and V-12 were added in their own optimal amounts, respectively, just before the coating.

The sizes of the silver bromide grains contained in the thus prepared silver halide photographic materials were measured using the foregoing method, and the results obtained were set forth in Table 5-1.

TABLE 5-1

| Sample | Additive | Addition Time of Additive | Grain Size | Note |
|---|---|---|---|---|
| 5-1 | — | — | 0.06 | Comparison |
| 5-2 | IV-9 | Just after Grain Formation | 0.020 | Invention |
| 5-3 | IV-31 | Just after Grain Formation | 0.015 | " |
| 5-4 | V-5 | Just after Grain Formation | 0.015 | " |
| 5-5 | V-12 | Just after Grain Formation | 0.015 | " |
| 5-12 | IV-9 | Just before Coating | 0.06 | Comparison |
| 5-13 | IV-31 | Just before Coating | 0.06 | " |
| 5-14 | V-5 | Just before Coating | 0.06 | " |
| 5-15 | V-12 | Just before Coating | 0.06 | " |

As can be seen from Table 5-1, the sizes of the silver halide grains contained in the silver halide photographic materials in accordance with the embodiments of this invention were equal to or slightly larger than those just after the grain formation because of the effect which the additives of this invention exerted on newly-formed grains, whereas in sample (5-1), which did not use any of the additives of this invention, and in samples (5-12), (5-13), (5-14) and (5-15), which used the additives of this invention out of accordance with every embodiment of this invention, growth of the grains was not inhibited to result in a great increase of grain size to 0.06 μm.

IMAGE FORMATION EXAMPLE 5-A

For the purpose of proving the utility of the silver halide photographic materials of this invention in the recording of holographic images, phase holograms were formed using a process which comprised dividing Ar-laser beams having a wavelength of 488 nm into two luminous fluxes by a half mirror to generate an interference fringe inside a prism brought into contact with a silver halide photographic material through xylene and thereby recording images. Since vibrations of samples and the optical system have a great influence on the results of the image recording, this experiment was carried out on an antivibration table. Other specific operations in the experiment were performed by consulting the descriptions in a book entitled *Fundamentals and Experiments of Holography,* on pages 85 to 184, edited by Akira Matsushita, written by Norimitsu Hirai, published by Kyoritsu Shuppan in 1979. In the formation of holograms, the diffraction efficiency upon the reproduction of images (brilliancy of reproduced images) becomes greater when a photographic material having a higher resolving power is used.

An improvement in diffraction efficiency can be achieved by using the silver halide photographic materials of this invention, as is demonstrated below in this experiment.

Each of the samples (5-4), (5-5), (5-14) and (5-15), which had a high sensitivity to light having a wavelength of 488 nm, was exposed to the interference fringe (intervals: about 0.2 μm) of light having a wavelength of 488 nm by performing the above-described operations. The thus exposed materials were developed in the following manner. The exposure of each sample was carried out under different conditions of illuminance, and the optimal exposure for achieving the maximum diffraction efficiency was determined thereby. The data for diffraction efficiency shown in Table 5-2 are values determined under the respective optimal exposure conditions.

TABLE 5-2

| Sample | Additive | Addition Time of Additive | Diffraction Efficiency (%) | Note |
|---|---|---|---|---|
| 5-4 | V-5 | Just after Grain Formation | 55 | Invention |
| 5-5 | V-12 | Just after Grain Formation | 55 | " |
| 5-14 | V-5 | Just before Coating | 25 | Comparison |
| 5-15 | V-12 | Just before Coating | 25 | " |

As can be seen from the data set forth in Table 5-2, the holograms formed by using the photographic materials of this invention manifested a diffraction efficiency higher than those formed by using the photographic materials prepared for comparison. These results demonstrate the utility of the silver halide photographic materials of this invention in the holographic image recording.

IMAGE FORMATION EXAMPLE 5-B

For the purpose of proving the utility of the silver halide photographic materials of this invention in recording electron-beam images with high density, a test pattern constituted by parallel lines at 0.20 μm intervals was recorded on the silver halide photographic materials of this invention by the use of electron beams having a beam diameter of 0.10 μm $\phi$.

Samples (5-1B), (5-2B), (5-4B), (5-12B) and (5-14B) were prepared in the same manner as the samples (5-1), (5-2), (5-4), (5-12) and (5-14), respectively, prepared in Example 5, except the cellulose triacetate film support was replaced by a polyethylene terephthalate film provided with a discharge membrane of $RbAg_4I_5$ protected by a nitrocellulose film, as shown in FIG. 2 (b) of JP-B-49-24282, the thickness of the emulsion coat was changed to 1 μm, and the Ag coverage was changed to 0.7 g/m$^2$. A test pattern constituted by parallel lines at 0.20 μm intervals was recorded on each of the thus prepared samples using electron beams having a beam diameter of 0.10 μm $\phi$ under an acceleration voltage of 70 kV. The photographic processing of these samples was carried out under the following condition.

| | | |
|---|---|---|
| Processing Steps: | | |
| Development | 20° C. | 3 minutes |
| Stop bath | 20° C. | 1 minute |
| Bleaching | 20° C. | 10 minutes |
| Washing | 20° C. | 2 minutes |
| KI bath | 20° C. | 2 minutes |
| Washing | 20° C. | 10 minutes |
| Air drying | | |
| Formula of Developer: | | |
| Pyrogallol | | 6.0 g |
| L-Ascorbic acid | | 6.0 g |
| Sodium carbonate | | 30.0 g |
| $H_2O$ to make | | 1.0 l |
| Formula of Stop Bath: | | |
| 0.5% Aqueous solution of acetic acid | | |
| Formula of Bleaching Solution: | | |
| Sodium ethylenediaminetetra-acetatoferrate(III) | | 100 g |
| KBr | | 10 g |
| $H_2O$ to make | | 1.0 l |
| Formula of KI Bath: | | |
| KI | | 2.5 g |
| $H_2O$ to make | | 1.0 l |

| | | |
|---|---|---|
| Processing Steps: | | |
| Development | 20° C. | 5 minutes |
| Stop bath | 20° C. | 1 minute |
| Fixation | 20° C. | 5 minutes |
| Washing | 20° C. | 10 minutes |
| Air drying | | |
| Formula of Developer: | | |
| Metol | | 2.5 g |
| L-Ascorbic acid | | 10.0 g |
| NABOX | | 35.0 g |
| KBr | | 1.0 g |
| $H_2O$ to make | | 1.0 l |
| Formula of Stop Solution: | | |
| 0.5% Aqueous solution of acetic acid | | |
| Formula of Fixer: | | |
| Sodium thiosulfate | | 60.0 g |
| Acetic acid | | 2.0 g |
| $H_2O$ to make | | 1.0 l |

When the thus processed comparison samples (5-1B), (5-12B) and (5-14B), were observed with a high resolution, field-emission type scanning electron microscope (Hitachi S-900), the line width of the recorded test pattern was not uniform and the density of line pieces in the linked state fluctuated noticeably, because the sizes of the developed silver grains in these samples (on the order of about 0.06 μm) were close to the width of the lines constituting the test pattern. In contrast, in the samples of this invention, the size of the developed silver halide grains was on the order of about 0.020 μm in sample (5-2B) and on the order of about 0.015 μm in sample (5-4B), which were definitely smaller than the line width of the test pattern, resulting in high uniformity in the line width and in density characteristics of the line pieces in the linked state on the recorded test pattern. The results of this experiment demonstrate that the silver halide photographic materials of this invention are well suited for the high density recording of electron beam images.

EXAMPLE 6

In this example, image formation using the silver halide photographic materials of this invention was demonstrated to be small in variation caused by the handling under daylight and excellent in tone reproducibility of halftone images.

Preparation of Samples for Comparison

Emulsion 6-a: An aqueous potassium bromide solution containing $8\times10^{-6}$ mol/mol Ag of $(NH_4)_3RhCl_6$ and an aqueous silver nitrate solution were added simultaneously over a 20-minute period to an aqueous gelatin solution kept at 30° C. During the addition, the pAg was kept at 7.5. Thus, a cubic fine grain emulsion having an average grain size of 0.06 μm was prepared. This emulsion was desalted using the flocculation process, and gelatin and the stabilizer (II-1), were added thereto in succession.

Emulsion 6-b; An emulsion was prepared in the same manner as emulsion 6-a, except the addition amount of $(NH_4)_3RhCl_6$ was changed to $5\times10^{-5}$ mol/mol Ag.

Emulsion 6-c: An aqueous sodium chloride solution containing $8\times10^{-5}$ mol/mol Ag of $(NH_4)_3RhCl_6$ and an aqueous silver nitrate solution were added simultaneously over a 10-minute period to an aqueous gelatin solution kept at 30° C. During the addition, the silver potential was kept at 100 mV. Thus, a cubic silver chloride fine grain emulsion having an average grain size of 0.10 μm was prepared. This emulsion was desalted using the flocculation process, and gelatin and the stabilizer (II-1) were added thereto in succession.

Four kinds of superfine grain emulsions were prepared in the same manner as the silver bromide superfine grain emulsions 1-E and 1-K (see Example 1) and the silver chloride superfine grain emulsions 2-14 and 2-19 (see Example 2), respectively. These emulsions were desalted using the flocculation process, admixed with gelatin, chemically sensitized with sodium thiosulfate and chloroauric acid, and then admixed with the stabilizer (II-1). Thus, the emulsions 6-d, 6-e, 6-f and 6-g, relating to this invention, were obtained.

To each of the thus obtained emulsions, from 6-a to 6-c (Comparison) and from 6-d to 6-g (Invention), polyethylacrylate latex was added in a proportion of 30 wt % to gelatin on a solids basis, and 2-bis(vinylsulfonylacetamido)ethane functioning as hardener was added so as to have a coverage of 80 mg/m². Each of the resulting emulsions was coated on a polyethylene terephthalate film so as to have a silver coverage of 2.0 g/m² and a gelatin coverage of 1 g/m². Simultaneously with the coating of this emulsion, an upper protective layer and a lower protective layer were coated on said emulsion layer. Therein, the upper protective layer was constituted by 0.5 g/m² of gelatin, 40 mg/m² of polymethylmethacrylate particles (size: 4 μm) as a matting agent, 50 mg/m² of silicone oil, and 2.5 mg/m² of coating aids including sodium dodecylbenzenesulfonate and a fluorine-containing surface active agent, $C_8F_{17}SO_2NC_3H_7CH_2CO_2K$, and the lower protective layer was constituted by 0.8 g/m² of gelatin, 100 mg/m² of polyethylacrylate latex, 5 mg/m² of thioctic acid, and sodium dodecylbenzenesulfonate. Thus, sample films 601 to 607 were prepared.

Each of the thus obtained samples was subjected to exposure through an optical wedge by means of a daylight printer P-607 (produced by Dainippon Screen Mfg. Co., Ltd.) and then developed at 38° C. for 20 sec. using an auto processor FG-660F (produced by Fuji Photo Film Co., Ltd.).

Evaluations of the relative sensitivity, fog after safelight exposure, and tone reproducibility were made as follows.

Relative Sensitivity: Sensitivity expressed relatively in terms of the reciprocal of the exposure required for obtaining a density of 1.5.

Fog after Safelight Exposure: Fog generated by the 60-minute exposure under 200 lux of a white fluorescent lamp FLR 40 SW (produced by Toshiba Corp.) and the subsequent development.

Tone Reproducibility: Exposure was performed under a condition in which a 100 μm-thick PET base was inserted as a spacer between a wedge having dot area % ranging from 2% to 98% and a sample, and the evaluation of halftone reproducibility was made thereby. More specifically, reproducibility of 2% and that of 98% were examined under the exposure condition in which the halftone dots of 50% were restored to 50%.

TABLE 6

| Sample | Emulsion | Grain Size (m) | Relative Sensitivity | Safelight Fog | Tone Reproducibility 2% (%) | Tone Reproducibility 98% (%) | Note |
|---|---|---|---|---|---|---|---|
| 601 | 6-a | 0.06 | 263 | 1.80 | 99 | 1 | Comparison |
| 602 | 6-b | 0.06 | 100 | 0.52 | 99 | 1 | " |
| 603 | 6-c | 0.10 | 90 | 0.40 | 100 | 1 | " |
| 604 | 6-d | 0.02 | 100 | 0.05 | 98 | 2 | Invention |
| 605 | 6-e | 0.03 | 251 | 0.25 | 98 | 2 | " |
| 606 | 6-f | 0.015 | 89 | 0.03 | 98 | 2 | " |
| 607 | 6-g | 0.03 | 200 | 0.20 | 98 | 2 | " |

As can be seen from Table 6-1, the fog caused by safe light exposure was less in general in the samples using the emulsions of this invention than in the comparison samples, and the tone reproducibility was quite good.

EXAMPLE 7

In this example, a method of recording images by subjecting the silver halide photographic materials of this invention to scanning exposure with laser beams was demonstrated to be excellent in fidelity of high density fine image recording.

Preparation of Samples for Comparison

Emulsion 7-a: An aqueous potassium bromide solution and an aqueous silver nitrate solution were added simultaneously over a 20-minute period to an aqueous gelatin solution kept at 35° C. During the addition, the pAg was kept at 7.5. Thus, a cubic fine grain monodisperse emulsion having an average grain size of 0.06 μm was prepared. This emulsion was desalted using the flocculation process, and gelatin and the stabilizer (II-1) were added thereto in succession.

Emulsion 7-b: An emulsion was prepared in the same manner as emulsion 7-a, except the addition time of the aqueous potassium bromide and silver nitrate solutions was changed to 10 minutes (grain size: 0.055 μm).

Three kinds of superfine grains were prepared in the same manner as the silver bromide superfine grain invention emulsions, 1-G and 1-H and the superfine grain comparison emulsion 1-A (prepared in Example 1), respectively. These emulsions were desalted and admixed with gelatin and the stabilizer (II-1) in succession. Thus, the emulsions 7-c, 7-d and 7-e were prepared.

A merocyanine dye V-12 was added to each of the thus prepared emulsions 7-a, 7-b (comparison), 7-c, 7-d (invention) and 7-e (comparison), in the amount determined as optimum for spectral sensitization. The resulting emulsion was coated on a glass plate so as to have a silver coverage of 3 g/m$^2$ and a gelatin coverage of 2 g/m$^2$. Thus, samples (7-1) to (7-5) were obtained.

These samples were scanned with Ar-laser beam having a wavelength of 488 nm. The scanning exposure was performed twice for each sample by controlling the diameter of the beam to be 2 μm and 5 μm, respectively, on the sample surface. Then, the samples were subjected to the following reversal processing.

| | | |
|---|---|---|
| Processing Steps: | | |
| Development (a) | 20° C. | 5 minutes |
| Bleaching | 20° C. | 5 minute |
| Washing | 20° C. | 1 minutes |
| Stabilization | 20° C. | 5 minutes |
| Washing | 20° C. | 1 minutes |
| Overall uniform exposure | | |
| Development (b) | 20° C. | 6 minutes |
| Washing | 20° C. | 10 minutes |
| Air drying | | |
| Formula of Developer (a): | | |
| Metol | | 4.0 g |
| Hydroquinone | | 2.0 g |
| Sodium carbonate | | 40.0 g |
| KBr | | 2.0 g |
| Sodium sulfite | | 40.0 g |
| Potassium thiocyanate | | 5.0 g |
| $H_2O$ to make | | 1.0 l |
| Formula of Bleaching Solution: | | |
| Potassium dichromate | | 5.0 g |
| Conc. sulfuric acid (specific gravity: 1.85) | | 10 ml |
| $H_2O$ to make | | 1.0 l |
| Formula of Stabilizing Bath: | | |
| Sodium sulfite | | 100.0 g |
| $H_2O$ to make | | 1.0 l |
| Formula of Developer (b): | | |
| Metol | | 1.0 g |
| Hydroquinone | | 5.0 g |
| Sodium carbonate | | 30.0 g |
| KBr | | 0.5 g |
| Sodium sulfite | | 40.0 g |
| $H_2O$ to make | | 1.0 l |

The thus processed samples were observed with a high resolution, field-emission type scanning electron microscope (Hitachi S-900), and the width of the lines recorded on each sample was measured. The results obtained are shown in Table 7-1.

TABLE 7-1

| Sample | Emulsion Used | Grain Size (μm) | Line Width Reproducibility 2 μm (μm) | Line Width Reproducibility 5 μm (μm) | Note |
|---|---|---|---|---|---|
| 7-1 | 7-a | 0.06 | 2.7 | 5.7 | Comparison |
| 7-2 | 7-b | 0.055 | 2.7 | 5.7 | " |
| 7-3 | 7-c | 0.02 | 2.0 | 5.0 | Invention |
| 7-4 | 7-d | 0.015 | 2.0 | 5.0 | " |
| 7-5 | 7-e | 0.06 | 2.5 | 5.5 | Comparison |

As can be seen from Table 7-1, an increase in line width was observed in each of the comparison samples (7-1), (7-2) and (7-5), whereas no increase in line width was observed in each of the invention sample (7-3) and (7-4); that is, high density recording was carried out faithfully with the present invention. These results demonstrate that the silver halide photographic material of this invention can provide a method of recording images of high density with scanning exposure.

While the invention has been described in detail and with reference to specific embodiments thereof, it will be apparent to one skilled in the art that various changes and modifications can be made therein without departing from the spirit and scope thereof.

What is claimed is:

1. A method of preparing a silver halide emulsion containing superfine grains, wherein said method is continuous and comprises feeding an aqueous solution of a water-soluble silver salt and an aqueous solution of a water-soluble halide to a mixing device furnished with an agitator and having a reaction chamber, mixing all the solutions in said device to form superfine silver halide grains, wherein the solutions are present in said device for a residence time (t) of 20 seconds or less, where the residence time is expressed by the following equation:

$$t = \frac{V}{a + b + c}$$

V: the volume of the reaction chamber in the mixing device (ml)

a: the amount of aqueous silver nitrate solution added (ml/min)

b: the amount of aqueous halide solution added (ml/min)

c: the amount of aqueous protective colloid solution added (ml/min), expelling an emulsion containing the formed superfine grains from said mixing device, and collecting the emulsion expelled from said mixing device, and the method further comprises forming the superfine grains in the presence of at least one of a high molecular weight compound and a substance capable of adsorbing to silver halide, each of which has a physical retardance value of at least 40 as determined by the PAGI method, to ensure an average grain size of 0.05 μm or less, wherein the method of preparing a silver halide emulsion containing superfine grains avoids the occurrence of Ostwald ripening.

2. The method of preparing a silver halide emulsion as claimed in claim 1, wherein said high molecular weight compound is selected from the group of a gelatin, a polyvinyl pyrrolidone, a polyvinyl alcohol, a polymer having a thioether group, a polyvinylimidazole, a polyethyleneimine, an acetal polymer, an amino polymer, an acrylamide polymer, a hydroxyquinoline-containing polymer, an azaindenyl group-containing polymer, a polyalkylene oxide derivative, a polyvinylamine imide, a polyvinylpyridine, an imidazolyl group-containing vinyl polymer, a triazolyl group-containing vinyl polymer, and a water-soluble polyalkyleneaminotriazole.

3. The method of preparing a silver halide emulsion as claimed in claim 1, wherein said substance capable of adsorbing to silver halide is a nitrogen-containing heterocyclic compound or a sensitizing dye.

4. The method of preparing a silver halide emulsion as claimed in claim 1, wherein said substance capable of adsorbing to silver halide is a mercapto- or quaternary nitrogen-containing heterocyclic compound.

5. The method of preparing a silver halide emulsion as claimed in claim 1, wherein said substance capable of adsorbing to silver halide is represented by formula (I) or (II):

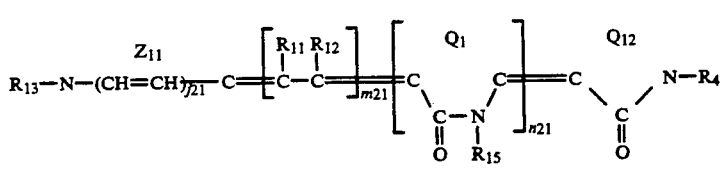

(II)

wherein $Z_{11}$ represents atoms to complete a 5- or 6-membered nitrogen-containing hetero ring; $Q_{11}$ represents atoms to complete a 5- or 6-membered nitrogen-containing ketomethine ring; $Q_{12}$ represents atoms to complete a 5- or 6-membered ketomethine ring; $R_{11}$ represents a hydrogen atom or an alkyl group; $R_{12}$ represents a hydrogen atom, a phenyl group, or an alkyl group; $R_{13}$ represents an optionally substituted alkyl or alkenyl group which may contain one or more oxygen, sulfur or nitrogen atoms in its carbon chain; $R_{14}$ and $R_{15}$ have the same meaning as $R_{13}$ and additionally represent a hydrogen atom or a monocyclic aryl group; $m_{21}$ represents 0 or a positive integer of 3 or less; $j_{21}$ represents 0 or 1; and $n_{21}$ represents 0 or 1.

6. The method of preparing a silver halide emulsion as claimed in claim 1, wherein said high molecular weight compound is added in an amount of at least 5 g/mol Ag and said substance capable of adsorbing to silver halide is added in an amount of at least $10^{-5}$ mol/mol Ag.

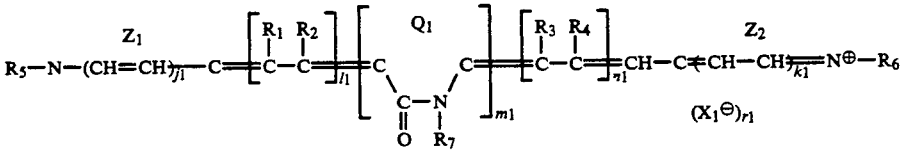

(I)

wherein $Z_1$ and $Z_2$, which may be the same or different, each represents nonmetal atoms completing a 5- or 6-membered nitrogen-containing hetero ring; $Q_1$ represents atoms to complete a 5- or 6-membered nitrogen-containing ketomethine ring; $R_1$, $R_2$, $R_3$ and $R_4$ each represents a hydrogen atom, a lower alkyl group, or an optionally substituted phenyl or aralkyl group; $R_5$, $R_6$ and $R_7$ each represents an optionally substituted alkyl or alkenyl group which may contain one or more oxygen, sulfur or nitrogen atoms in its carbon chain; $l_1$ and $n_1$ each represents 0 or a positive integer Of 3 or less, provided that $l_1+n_1$ is 3 or less; $j_1$, $k_1$ and $m_1$ each represents 0 or 1; $X_1\ominus$ represents an acid anion; and $r_1$ represents 0 or 1, 7. The method of preparing a silver halide emulsion as claimed in claim 1, wherein the silver halide emulsion containing the superfine silver halide grain having the average grain size of 0.05 μm or less is subjected to desalting.

8. The method of preparing a silver halide emulsion as claimed in claim 1, wherein the silver halide emulsion containing the superfine silver halide grain having the average grain size of 0.05 or less is subjected to desalting and chemical sensitization.

* * * * *